US006964226B2

(12) United States Patent
Weiss et al.

(10) Patent No.: US 6,964,226 B2
(45) Date of Patent: Nov. 15, 2005

(54) METHOD OF TRANSFERRING A MEMBRANE IMAGE TO AN ARTICLE IN A MEMBRANE IMAGE TRANSFER PRINTING PROCESS

(75) Inventors: Keith D. Weiss, Fenton, MI (US); Jason Beaudoin, West Bloomfield, MI (US); Eric van der Meulen, Wixom, MI (US); Bien Trong Bui, Howell, MI (US)

(73) Assignee: Exatec, LLC, Wixom, MI (US)

( * ) Notice: Subject to any disclaimer, the term of this patent is extended or adjusted under 35 U.S.C. 154(b) by 45 days.

(21) Appl. No.: 10/793,494

(22) Filed: Mar. 4, 2004

(65) Prior Publication Data

US 2005/0193905 A1 Sep. 8, 2005

(51) Int. Cl.[7] ..... B41M 1/12
(52) U.S. Cl. ..... 101/129; 101/127
(58) Field of Search ..... 101/126, 127, 101/129; 427/272, 282

(56) References Cited

U.S. PATENT DOCUMENTS

| | | | | |
|---|---|---|---|---|
| 4,932,175 | A * | 6/1990 | Donnally | 52/118 |
| 2003/0070569 | A1 * | 4/2003 | Bulthaup et al. | 101/127 |
| 2003/0116047 | A1 | 6/2003 | Cutcher | |

* cited by examiner

*Primary Examiner*—Eugene H. Eickholt
(74) *Attorney, Agent, or Firm*—Brinks Hofer Gilson & Lione

(57) ABSTRACT

The present invention involves a method of transferring a membrane image to an article. The method comprises providing a printed decoration to be applied onto a low surface energy membrane. The low surface energy membrane has a hardness level of greater than 70 durometer Shore A and a surface energy of up to 25 mJ/m$^2$. The method further includes applying a predetermined pressure with a pressure device to force the printed decoration through a screen onto the low surface energy membrane. The pressure device has a hardness of up to 70 durometer Shore A. The method further includes forming the low surface energy membrane to the geometry of the surface of the article and applying pressure between the membrane and the article to transfer the membrane image from the membrane to the article.

42 Claims, 10 Drawing Sheets

[A] Opacity = 97.83%

[B] Opacity = 100.00%

$$\gamma_{SV} = \gamma_{SL} + \gamma_{LV} \cos(0)$$

Young's Equation

METHOD OF TRANSFERRING A MEMBRANE IMAGE TO AN ARTICLE IN A MEMBRANE IMAGE TRANSFER PRINTING PROCESS

TECHNICAL FIELD

This invention relates to optimizing screen printing parameters to apply an ink pattern to a soft, low surface energy membrane that subsequently result in a print after transfer to a plastic substrate, exhibiting acceptable opacity and image texture or quality.

BACKGROUND OF THE INVENTION

Molded plastic articles are becoming widely accepted as a replacement for metallic and glass articles. One advantage associated with molded plastic articles is the integration of several components into one article, thereby reducing the number of assembly operations. In other words, an article that previously was comprised of several components bonded or joined together may be manufactured in a one step, molding operation. One inherent problem that has resulted from the advent of this practice is the ability to print upon the resulting complex (concave, convex, etc.) surface shape of the article. Printing is desirable since other means for disposing images are timely and the use of several 2-dimensional printing concepts, namely screen-printing and pad-printing, have been extended to meet this need with only limited success.

Screen-printing is a known commercial process and is described in greater detail below. Screen printing is limited in the complexity of the surface upon which may be printed. This technique represents a very economical method for printing onto a "flat" substrate. Screen-printing has been applied to curved surfaces through the implementation of a technique known as in-mold decoration (IMD). In this technique the printed image is applied via screen-printing to a "flat" film. This film is then held via vacuum to the surface of the mold. The film becomes part of the surface of the article upon the injection of the plastic material into the mold. Major difficulties associated with the use of this technique are the registration of the decoration on the article's surface and a limitation in surface complexity of the article. Decoration registration requires accurate positioning of the film into the mold for each article reproduction. Surface complexity is limited by the ability of the film to conform (e.g., stretch) to the shape of mold to be incorporated as part of the article's surface.

Pad-printing is also a known commercial printing process and is described in greater detail below. Pad-printing is a printing process which uses a tampon and a cliché to stamp or print onto a convex curved surface. In fact, pad-printing or tampography is a form of indirect or offset gravure printing that is accepted by the automotive industry for the decoration of interior components. Pad or tampon printing is an economical technique capable of providing fine line (32 micrometer) resolution on both curved and uneven surfaces. However, this technique is limited in the degree of complex curvature, radius, and size of the substrate to be printed, as well as in the design of the substrate's edge up to which one may desire to print.

Membrane image transfer (MIT) printing (discussed below) is a new printing concept that combines both screen-printing and pad printing (tampography) into one method for the decoration of articles with complex shape. MIT printing offers the ability to print articles with complex shape with the print resolution and opacity normally obtained with screen-printing on flat substrates. However, manufacturers have been challenged in optimizing variables related to the performance of ink in MIT printing and improving this process related to screen printing of an image onto a membrane and transferring the image from the membrane to a substrate.

SUMMARY OF THE INVENTION

The present invention optimizes variables related to the performance of ink in MIT printing, the process of screen printing of an image onto a soft, low surface energy membrane, and the process of transferring this image from the membrane to a substrate.

In one embodiment, the present invention provides a method of transferring a membrane image to an article. The method comprises providing a printed decoration to be applied onto a low surface energy membrane. The low surface energy membrane has a hardness level of greater than about 70 durometer Shore A and a surface energy of up to 25 mJ/m$^2$. The method further includes applying a predetermined pressure with a pressure device to force the printed decoration through a screen onto the low surface energy membrane. The pressure device has a hardness of up to about 70 durometer Shore A. The method further includes forming the low surface energy membrane to the geometry of the surface of the article and applying pressure between the membrane and the article to transfer the membrane image from the membrane to the article.

Other features and advantages of the invention will be apparent from the following detailed description and the accompanying drawings.

BRIEF DESCRIPTION OF THE DRAWINGS

FIGS. 14*a*–14*b* are plots that depict the interaction curves obtained in a design of experiment, indicating the affect the applied force has on the opacity of the applied print and the percentage of ink transferred;

ADDITIONAL BACKGROUND OF PRIOR ART

Figure 1:
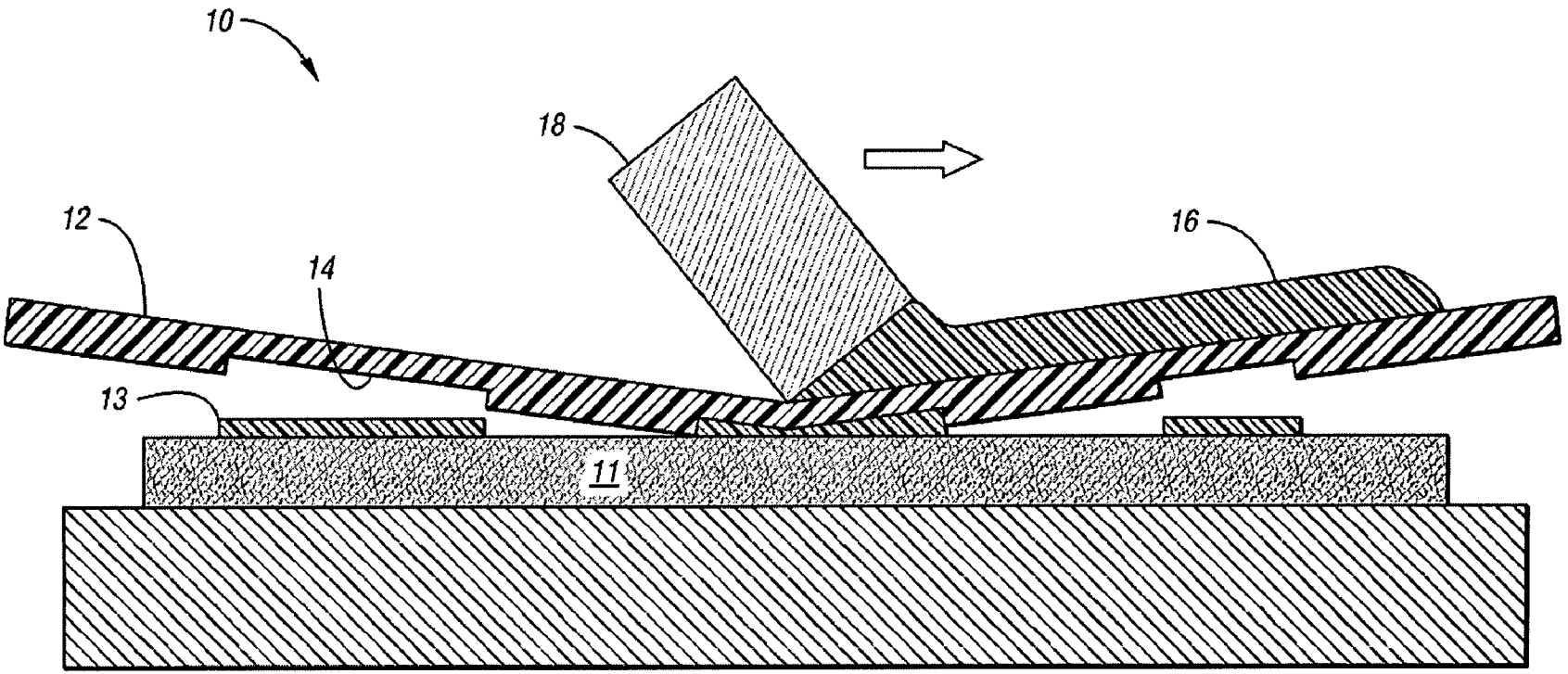
Fig. 1 (PRIOR ART)
FIG. 1 is a schematic of a conventional screen-printing process utilizing a squeegee to push an ink through a screen mesh for deposition onto a flat substrate.

Screen-printing is a known commercial process. A schematic of a screen-printing process is shown in FIG. 1 and represented by reference numeral 10. Screen-printing process 10 is used to apply a print to a flat substrate 11 with uniform ink thickness. The process 10 involves the use of a screen 12 that exhibits an open mesh 14 in the shape of the desired graphic pattern. The screen 12 is positioned parallel to the substrate 11 to be printed at a specified off-contact distance. The screen is then flooded with ink 16, followed by the movement of a squeegee 18 across the surface of the screen. The downward pressure applied by the squeegee during this movement forces the ink through the open mesh representing the graphic pattern in the screen. After the squeegee passes a region, the tension of the stretched screen along with the off-contact distance between the screen and the substrate allows the screen to separate from the ink deposited in that region.

Figure 2:
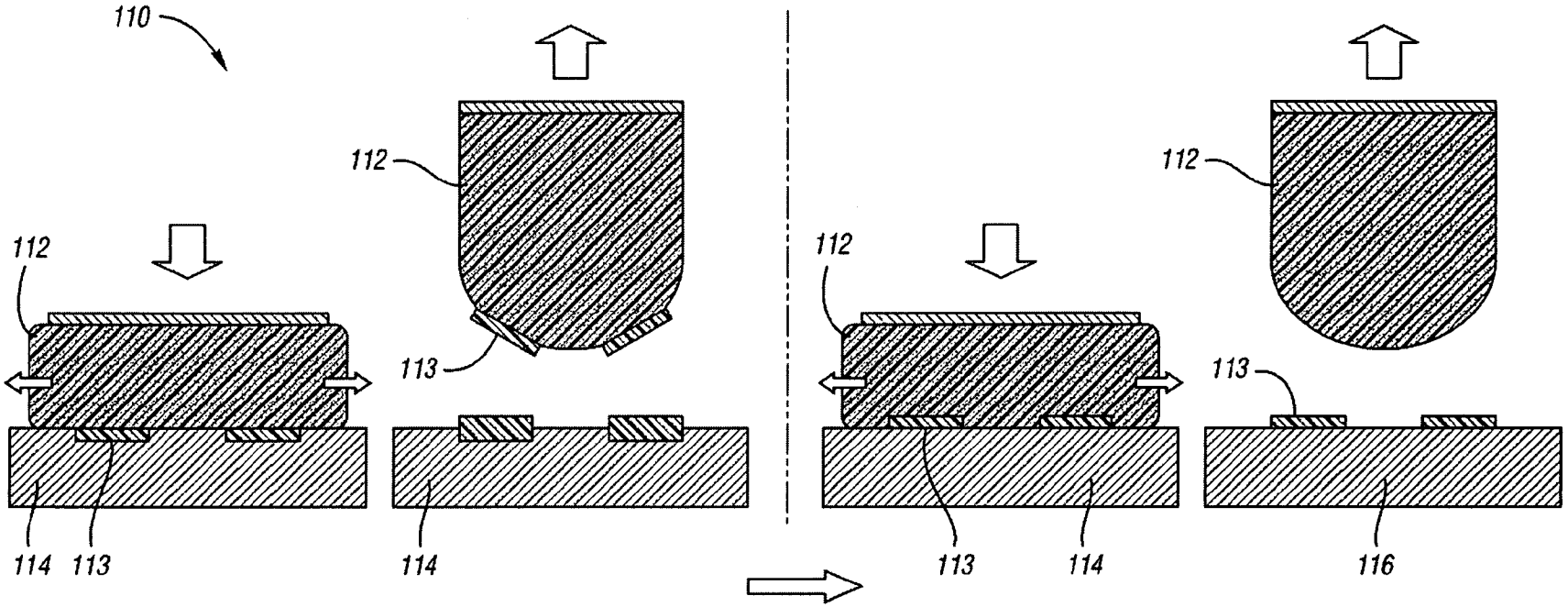
Fig. 2 (PRIOR ART)
FIG. 2 is a schematic of a conventional pad-printing process including ink pick-up from an engraved cliche by a transfer pad followed by deposition of the ink onto a substrate via applied pressure.

In a typical pad-printing process, an engraved plate known as a cliche is flooded with ink. A schematic of a pad-printing process is shown in FIG. 2 and represented by reference numeral 110. Any excess ink on the cliche is removed through the use of a doctoring blade. A pad or tampon 112 is used to pick up ink 113 from a cliche 114. The tampon is then moved over to a substrate 116 that is to be printed. Upon contact with the substrate, the tampon is rolled across the substrate's surface. The ink 113 image is finally released from the tampon 112 as it is lifted off of the substrate 116. The pitch (thickness & angle) associated with the tampon 112 is highly dependent upon the shape and fragility of the substrate 116 to be printed. The pitch and shape (round, rectangular, or bar) of the tampon 112 are typically selected to achieve a rolling action when the ink 113 is picked up from the cliche 114 and deposited onto the substrate 116. Tampons with a flat profile are usually avoided due to their propensity to trap air between the tampon and substrate, thereby, causing a defect in the applied print.

Significant differences between screen-printing and pad-printing exist with respect to the composition of the ink utilized. Typically, the inks used in these two application methods are very different in their solvent make-up. In order not to dry in the screen, the ink formulations used in screen-printing contain solvents whose evaporation rates are lower than those used in pad-printing inks. In pad-printing ink formulations, solvent evaporation is utilized to modify Theological properties and surface tension in order to provide a "tacky" film on the pad during transfer. Thus many commercial screen-printing and pad-printing inks will not optimally function in a printing process that combines both conventional printing techniques into one method, such as MIT printing.

Moreover, significant differences between MIT printing and either conventional screen-printing or conventional pad-printing exist with respect to various ink parameters, membrane/substrate properties, and process/application variables. Ink parameters for MIT printing include rheology and surface tension, with composition being a factor to survive accelerated automotive test protocols. Several substrate properties that affect the ability to print via a MIT process include surface energy and hardness. Finally, overall process variables that are to be optimized for screen printing an image onto the membrane include the hardness of the squeegee, the force applied to the squeegee, the transverse speed of the squeegee, and the amount of time the screen is flooded with ink. Additional process variables that are to be optimized for the transfer of the image from the membrane to a substrate, such as a plastic window, include the amount of time between applying the print to a "soft" membrane and transferring the print from the membrane to a "hard" substrate, the peel angle, and the amount of pressure applied between the formed membrane and the substrate to facilitate transfer of the print, among others. Thus, there is a need in the industry to optimize all variables related to the performance of the ink, the screen printing of an image onto a soft, low surface energy membrane, and transferring this image from the membrane to a substrate.

DETAILED DESCRIPTION OF THE INVENTION

The following description of the preferred embodiment is merely exemplary in nature and is in no way intended to limit the invention or its application or uses.

The present invention provides a detailed specification for the screen printing process parameters preferably used to print an image onto a "soft", low surface energy membrane that will provide an acceptable print after being transferred from the membrane to a "hard" (e.g., plastic, etc.) substrate via a membrane image transfer (MIT) process. The primary properties associated with screen printing that affect the ink thickness (i.e., opacity) and quality of the print arising from membrane image transfer printing has been found to be the magnitude of the force applied by the squeegee to the screen, the hardness of the squeegee, and the hardness of the "soft" membrane. Optimal ranges for other screen printing process variables, such as off-contact distance, flood time, screen mesh, squeegee transverse speed, squeegee angle, and screen composition, as well as membrane characteristics, such as thickness, cleanliness, surface energy, surface polarity, and composition, are also established.

Figure 3A:
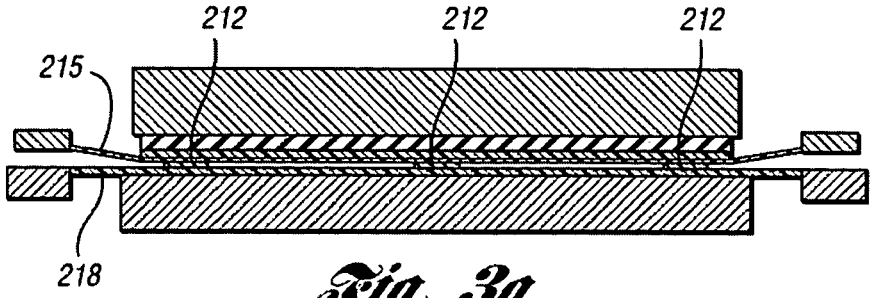
FIGS. 3*a*–3*d* are schematic diagrams of a membrane image transfer (MIT) process.
Figure 3B:
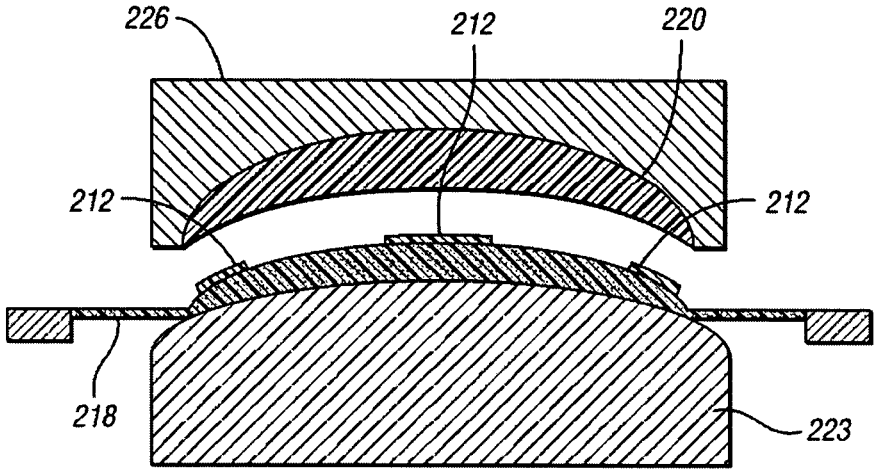
Figure 3C:
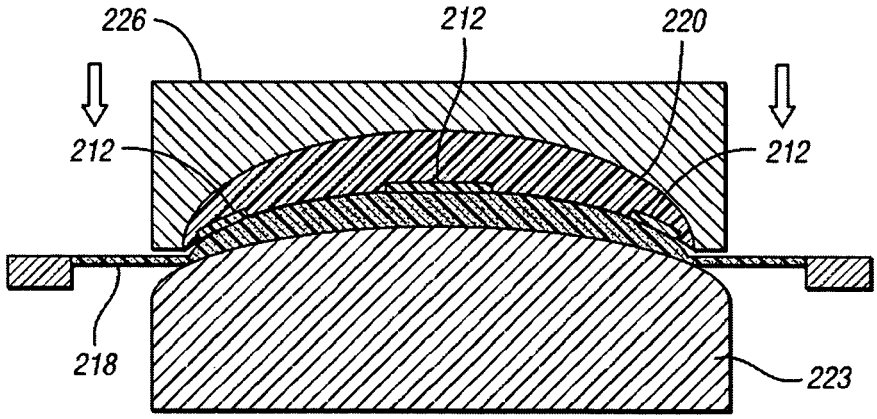
Figure 3D:
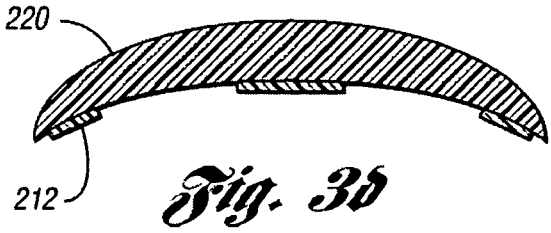

A schematic of an MIT process is shown in FIGS. 3*a*–3*d*. MIT printing offers the ability to print articles with complex shape with the print resolution and opacity normally obtained with screen-printing on flat substrates. As shown in FIGS. 3*a*–3*d*, ink is used in membrane image transfer (MIT) printing. In this embodiment, a printed decoration 212 is applied through a screen 215 to a flat "soft" membrane 218 via the use of conventional screen-printing as mentioned above and depicted in FIG. 3*a*. The membrane 218 is then deformed or reshaped to the geometry of the surface of an article 220 through the use of a form fixture 223 resembling the mirror image of the article 220 as depicted in FIG. 3*b*. The deformed membrane 218 and the article 220 held in a part fixture 226 are then pressed together in forced contact as depicted in FIG. 3*c*. The application of pressure between the article 220 held in part fixture 226 and the formed membrane 218 results in the transfer of the screen-printed image from the membrane 218 to the article 220 as depicted in FIG. 3*d*.

The inventors have found that screen printing onto either a "hard" substrate or a "soft" substrate provides similar results with respect to ink thickness, but vastly different results with respect to pattern quality or image texture. The pattern quality was observed to suffer from the existence of transparent lines (lack of ink) and/or holes resulting from the screen mesh. The end result was a decrease in opacity due to the lack of ink in the area of the transparent lines as demonstrated in FIG. 4. In this figure, "soft" (white) membrane 312 can be seen through a first printed image 313, while a second image 314 screen printed onto a "hard" plastic substrate is observed to be totally opaque. Identical results on both "hard" and "soft" substrates were obtained independent of the substrate's material composition. For example, the inventors observed total coverage or a solid image texture for images screen printed onto "hard" substrates, such as PC, TPO, ABS, and nylon (all obtained from the Polymer Laboratory, Eastern Michigan University). Similarly, incomplete coverage or image texture was observed when screen printing onto "soft" substrates, such as a silicone membrane (SIL60, Kuriyama of America), a nitrile membrane (W60, Kuriyama of America), a fluorosilicone membrane (MIL-25988, Jedtco Corp.), or a fluorocarbon elastomer (Viton, Daemar Inc.).

In addition to the level of hardness, the low surface energy associated with these "soft" substrates also influences the occurrence of the transparent lines and holes by inhibiting the ink to flow after being applied to the membrane. The surface energy exhibited by each of the membranes described above is known to be approximately equal to or less than the surface tension exhibited by typical ink formulations (e.g., surface tension of inks are greater than about 25 dynes/cm or mN/m). Surfaces whose structure predominately contain either —CH3, —CF2, or —CF3 groups as is the case for the "soft" membranes described above are known to exhibit a surface energy typically less than or equal to 25 mJ/m2 or erg/cm2.

The thickness of the ink applied via screen printing to "soft" or "hard" substrates was observed to be similar through the use of interferometry. The use of a conventional form of profilometry was found to produce unreliable results. The measured thickness for the ink film printed onto a "soft" substrate using profilometry was typically measured to be higher than that measured via interferometry. More specifically, interferometry measured a less than 5% difference between the thickness of the ink applied to a "hard" polycarbonate substrate and a "soft" silicone membrane. In comparison, a greater than 50% difference in ink thickness for these same samples was observed upon obtaining measurements via profilometry.

The main reason for the erroneous results using a profilometer lies in the fundamental difference between interferometry and profilometry. Interferometry represents a non-contact method that utilizes the creation of a light/dark fringe pattern via constructive and destructive interference of white light reflected from the sample and reference targets. This technique can obtain quantitative information concerning texture, roughness, and step height distances. On the other hand, profilometry is a contact method that drags a stylus across the surface under an applied force to obtain step height information. Profilometry is a suitable technique for "hard" substrates as shown by the similarity between measurements taken for ink deposited on several types of thermoplastic substrates. However, this technique measures a similar ink film deposited onto "soft" substrates as being much thicker than that deposited on "hard" substrates. The stylus is believed to push into the "soft" substrate under the applied force, thereby, causing the initial reference point or baseline to be depressed below the "true" surface of the membrane. The end result is the measurement of a larger step height to reach the surface of the deposited ink film. This effect was found to be further exaggerated upon using either a conical stylus with a smaller diameter tip (e.g., 2.5 $\mu$m tip) or applying a greater force (e.g., maximum=20 mg) to the stylus.

Squeegee hardness, squeegee angle, the force applied to the squeegee, screen mesh, squeegee transverse speed, and the amount of time the screen is flooded with ink are the key screen printing process variables that may affect the performance of the ink with respect to printed thickness (e.g., opacity) and image quality. The inventors evaluated each of these variables through the use of several inter-related experimental designs (DOEs). The DOEs performed included several full factorial experiments utilizing laboratory scale or bench-top apparatus and one fractional factorial screening experiment incorporating a production prototype MIT process for polycarbonate windows. All of these DOEs formed the baseline to which the subsequent printing onto a "soft" substrate & transfer to polycarbonate were compared and optimized by the inventors.

For clarification, a "soft" membrane and a "hard" substrate are defined by their hardness value as specified in ASTM D2240-03. Typically, a "soft" membrane represents an elastomeric material whose hardness is usually measured on the Shore A scale. Examples of "soft" materials include rubbers and elastomers, such as nitrile, polydimethylsiloxanes, EPDM, neoprene, fluorosilicone, and fluorocarbon elastomers, among others. A "hard" substrate represents a thermoplastic material whose hardness is typically measured on a different scale, such as the Shore D or Rockwell R scales. Examples of thermoplastic materials include TPO, ABS, polycarbonate, and nylon, among others.

Figure 5:
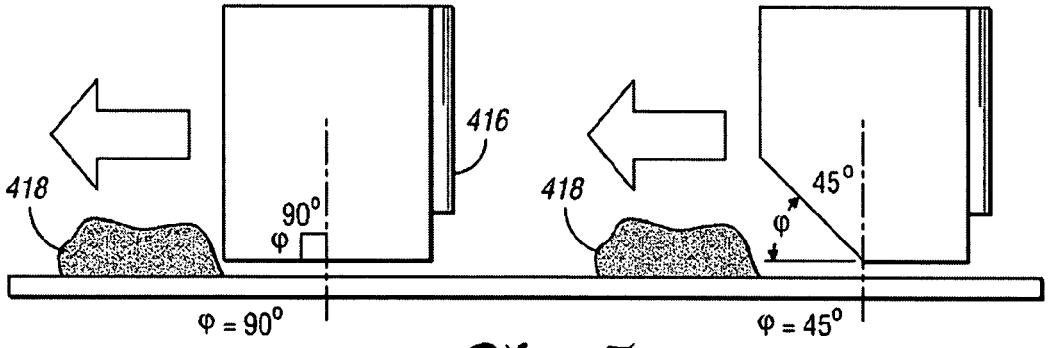
FIG. 5 is a schematic view of an application of a squeegee angle ($\phi$) in design of experiments in accordance with one embodiment of the present invention.

The squeegee angle is defined as the angle of contact made between the squeegee's center line and the screen during the printing process. As shown in FIG. 5, the contact with screen 412 is made with the middle of the squeegee 414 width. The squeegee angles selected for evaluation in several of the DOEs were 0.0° and 45.0°. The squeegee 414 angle was maintained during each experimental trial through the use of a metal support brace 416 placed on the back of the squeegee 414 encompassing approximately $^{3}$/of the exposed area.

The force applied to the squeegee 414 can be represented by the number of turns on the squeegee pressure control bar away from the established midpoint employed during screen printing with ink 418. The midpoint of the applied force is determined by establishing through a quick, simple trial and error experiment, the high and low limits for printing onto the substrate. The low limit is established at the point (e.g., number of turns) where an incomplete print is applied to the substrate. The high limit is established at the point where the print begins to become distorted or "smear" due to the presence of too much ink being deposited. The midpoint of the applied force then represents the point ½ or mid-way between the high and low limits. This technique is appropriate for many low technology screen printers that are commercially available, such as a Saturn model, M&R Screen Printing Equipment Incorporated. Typically, one turn on the squeegee pressure control bar is equivalent to a 2 mm displacement of the squeegee. The inventors have found that about a 4 mm separation is usually encountered between the low and high limits. Thus a rough estimate of determining the midpoint is to establish the low point and then increase the squeegee displacement by 2 mm. Defining the force applied to the squeegee using these methods adjusts for the differences that may be encountered for the "off-contact" distance between the screen and the substrate. The "off-contact" distance is usually established between about 3 to 12 mm. The established mid-point for the applied squeegee force (e.g., number of turns) is dependent upon the selected "off-contact" distance.

Figure 6A:
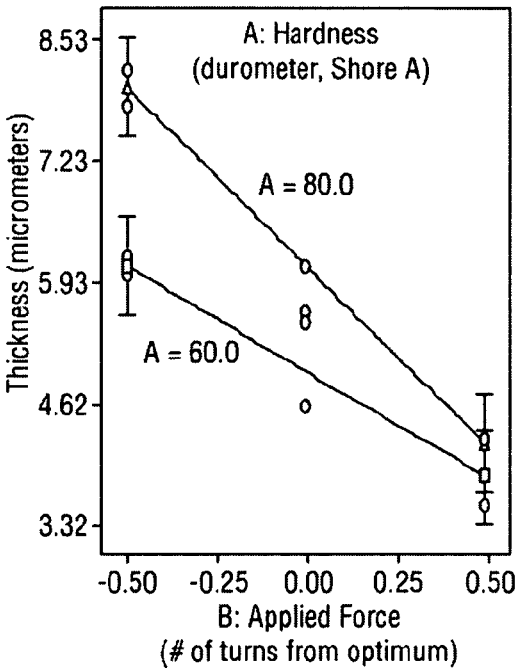
FIGS. 6*a*–6*b* are plots that depict interaction and response surface curves obtained in a design of experiment, indicating the affect squeegee hardness and applied force have on the thickness of the ink layer transferred from a "soft" (silicone) membrane to a "hard" (polycarbonate) substrate via a membrane image transfer (MIT) process.
Figure 6B:
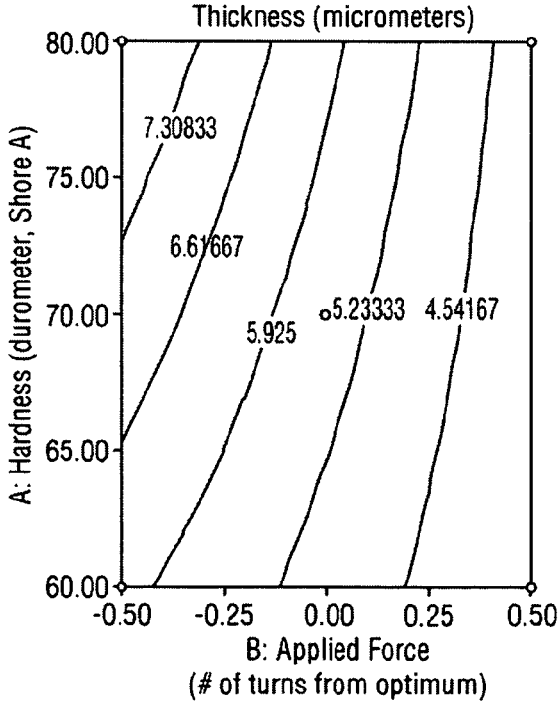

All of the previously described main screen printing variables were found to affect the thickness of the ink layer applied to a "soft" membrane with subsequent transfer to a "hard" substrate via a membrane image transfer (MIT) process. The applied force and hardness of the squeegee were found by the inventors to be the most sensitive parameters exhibiting the greatest impact on the thickness of the transferred ink layer. The applied force was also found to enter into significant secondary interactions with both the hardness and angle of the squeegee. These secondary interactions were observed to compliment the main variable effects. The interaction plot and response surface for these variables with respect to transferred ink layer thickness is shown in FIGS. 6*a*–6*b*.

The thickness of the ink film deposited onto a "soft" membrane and subsequently transferred to a "hard" substrate was observed to dramatically increase when the applied force was low and the squeegee hardness high. More specifically, when the applied force was elevated (e.g., +0.5 turns above the established midpoint) the hardness of the squeegee (see FIGS. 6*a*–6*b*) had little impact on the thickness of the transferred ink film. However, when the applied force was decreased, the hardness of the squeegee was found to have a significant affect. Although the ink layer thickness was observed to increase at all squeegee hardness values as the applied force was decreased, the maximum change was encountered with a squeegee of high hardness (80 durometer, Shore A). As shown in the response surface (see FIG. 6*b*), a significant amount of curvature was encountered in the experimental data.

The desired or optimum ink thickness of about 4.0–6.0 $\mu$m within the overall limit of about 4.0 to 10.0 $\mu$m was obtainable with the application of an applied force or pressure close to the determined midpoint setting (0.00±0.25 turns). The thickness of the ink directly correlates with the opacity of the print. A minimum thickness of approximately 4.0 to 5.0 $\mu$m is preferred for the opacity of the printed image to be near 100%. Although the desired ink thickness can be obtained via the use of a squeegee within the range of 60–80 durometer, Shore A, it is recommended that a squeegee of low durometer (e.g., <70 durometer, Shore A) be used for obtaining the appropriate ink layer thickness due to the interaction this variable has with the applied force or pressure. Careful adjustment of the applied force is indicated by the sensitivity of this setting to ±0.25 turns. Periodic examination of the screen to insure adequate mesh tension is recommended in order not to affect the magnitude of the applied force.

The ink thickness (e.g., opacity) was found to a lesser degree to be influenced by the screen mesh count and the amount of time the screen is flooded with ink. In particular, the thickness of the print can be increased by the use of a screen mesh count that is less than 230 mesh. Screens are available with the preferred mesh counts of either 160 or 200 mesh. The amount of time the screen is flooded with ink is preferred to be maximized in order to enhance the thickness of the applied print. A flood time greater than 30 seconds is preferred for increasing the thickness of the applied print. In addition, the inventors discovered that the opacity of the printed image could also be enhanced through the unique control of the squeegee's transverse speed. Due to the shear thinning behavior exhibited by typical inks, starting the squeegee at a high speed, greater than about 0.34 m/sec (e.g., a setting between 2 to 11 on a Saturn screen printer, M&R Screen Printing Equipment Inc.) was found to assist in enhancing the opacity of the applied image. The high speed causes the shear rate encountered by the ink to be higher, which in turn causes a substantial decrease in the viscosity of the ink. Thus the ink more readily flows through the screen onto the "soft", low surface energy membrane. The transverse speed of the squeegee may be reduced towards the end of its stroke in order to prevent the mechanical arm from impacting the machine's stop mechanism with great force.

All DOE results were duplicated for both a squeegee with an angle of 0° and 45°. Thus a squeegee with either type of angled surface may be utilized with similar results. The midpoint of the applied force for each squeegee type was observed to be different from one another. In other words, even though two squeegee's with different angles may exhibit the same hardness, each squeegee will preferably have a different applied force setting (e.g., turns) to establish a midpoint. A ball nose squeegee was found to deposit the greatest ink thickness. The inventors unexpectedly determined that unlike the flat (0°) or angled squeegees (45°), an acceptable print using a ball nose squeegee allowed the squeegee to exhibit a higher level of hardness. A hardness greater than about 80 durometer, Shore A is preferred for the ball nose squeegee. Thus a ball nose squeegee can be utilized to maximize the ink thickness if so desired towards its high limit of about 10 $\mu$m provided the preferred durometer is utilized.

The inventors through further experimentation discovered that the main variables significantly affecting the image texture (e.g., pattern quality) of the applied print included both squeegee hardness and applied force. Squeegee hardness was further found to enter into a significant secondary interaction with the applied force. Again this secondary interaction was observed to compliment the main variable effects.

Figure 7A:
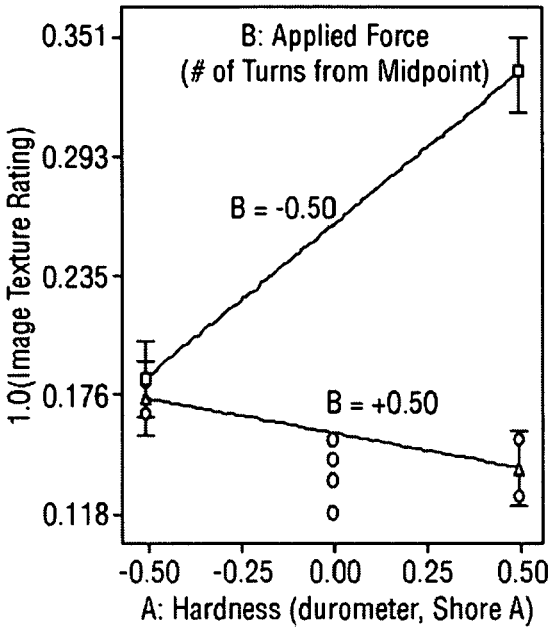
FIGS. 7*a*–7*b* are plots that depict interaction and response surface curves obtained in a design of experiment, indicating the affect squeegee hardness and applied force have on the image texture or quality of the ink layer transferred.
Figure 7B:
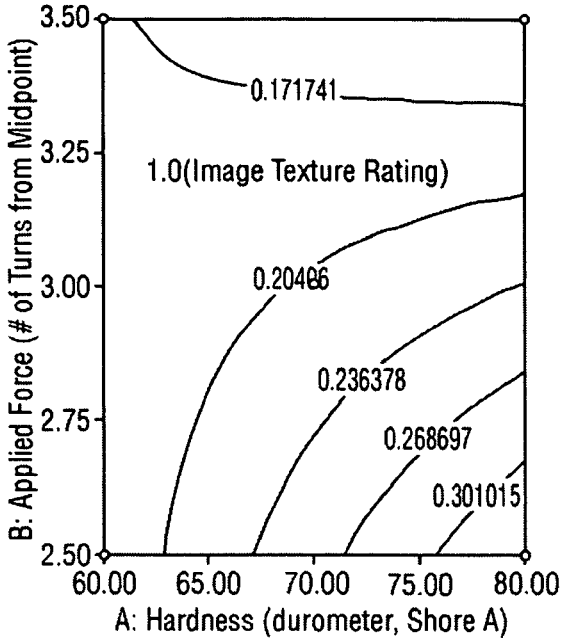

The best model that was found to adequately fit the measured image texture data was an inverse transform. In other words, the best image texture existed when 1/(Image Texture) was minimized. The image texture or quality rating was a subjective number (10=best, 0=worst) arrived at by considering the presence of pinholes caused by the vertices of the screen mesh, transparent screen mesh lines, presence of a shadow, and loss of detail. The interaction plot and response surface generated for these variables with respect to image texture are shown in FIGS. 7*a*–7*b*.

The image texture of the applied ink film was observed to improve when the hardness of the squeegee was low. More specifically, when the squeegee hardness was low (e.g., 60 durometer, Shore A), the applied force (FIGS. 7*a*–7*b*) had very little impact on the quality of the printed image. However, when the squeegee hardness was increased, the applied force was found to have a significant effect. The deterioration of the image texture or quality was observable at high squeegee hardness when low force (e.g., −0.5 turns from midpoint) was applied.

Several numerical calculations were performed using the objective desirability function available in a typical statistical software package (Design Expert®, StatEase, Minneapolis, Minn.) in order to optimize the thickness and image texture of the deposited ink film, thereby, providing the best pattern quality and opacity level. The optimization parameters assigned to each process variable and measured response used for this calculation is provided in Table 1. The range in ink thickness used to obtain an acceptable level of opacity is known for many conventional screen printing and pad printing inks to be between 4.0–10.0 micrometers with between 4.0 to 6.0 micrometers being preferred. The desired range in applied force and squeegee hardness for these calculations were taken to be the overall range utilized in the previously described Design of Experiments. A high (desired) image texture rating was exemplified by having a low inverse ratio (1.0/image texture) as indicated by the inverse transform model.

The numerical solution obtained from this analysis for each squeegee angle is shown in Table 1. Each of these solutions are anticipated to provide the preferred results when using a squeegee with either a 0° or 45° angle to deposit ink onto a "soft" membrane. Within the ranges evaluated in the DOEs described above, a low (<70 durometer, Shore A) hardness squeegee and the application of an applied pressure close to the determined midpoint setting (0.00±0.25 turns) is preferred. A key observation regarding this analysis of the measured data is that the image screen printed onto the "soft" membrane adequately represents the final image obtained on "hard" substrate after MIT processing.

TABLE 1

PREFERRED CRITERIA

Squeegee hardness being in the range of 60–80 durometer, Shore A
Applied force being in the range of +/− 0.5 turns from determined midpoint
Ink thickness being in the range 4.0–10.0 micrometers
MINIMIZE the inverse 1.0/(Texture) ratio
SOLUTIONS

| Squeegee Hardness (durometer, Shore A) | Applied Force (number of turns from determined midpoint) | Ink Thickness (micro-meters) | 1.0/Image Texture Ratio |
|---|---|---|---|
| Squeegee Angle = 0° | | | |
| 66.8 | +0.20 | 4.27 | 0.170 |
| 66.1 | +0.20 | 4.22 | 0.170 |
| Squeegee Angle = 45° | | | |
| 60.0 | −0.25 | 8.73 | 0.165 |
| 60.0 | +0.18 | 8.70 | 0.188 |

The inverse of image texture (1.0/image texture) range of about 0.17 to 0.19 for a print transferred to a "hard" (polycarbonate) substrate from a "soft", low surface energy membrane is higher than that obtained for screen printing an image directly onto a "hard", substrate. The range for the inverse of image texture obtained for direct screen printing onto a "hard" substrate was found to be on the order 0.10–0.13. A lower inverse image texture ratio corresponds to a higher level of print quality. Thus screen printing onto a "soft" membrane followed by MIT processing provides a print of lower quality than that obtained by directly screen printing onto a "hard" substrate. Although the ink layer thickness present on a "soft" membrane is similar to that present on a "hard" substrate, the image quality is lower as exemplified by the occurrence of transparent lines and holes left by the screen mesh (see FIG. 4).

The inventors have discovered that the image quality or texture of a print obtained via MIT processing (e.g., screen printed onto a "soft" membrane & transferred to a "hard" substrate) can be dramatically improved by increasing the hardness of the membrane material from 60 durometer, Shore A to greater than about 70 durometer, Shore A. Since increased membrane hardness is caused by a greater degree of cross-linking between polymer chains, a decrease in elongation characteristics is observed. Thus a negative affect of increasing the hardness of the membrane material is a limitation regarding the degree of curvature in the substrate that can be accommodated.

Figure 8A:
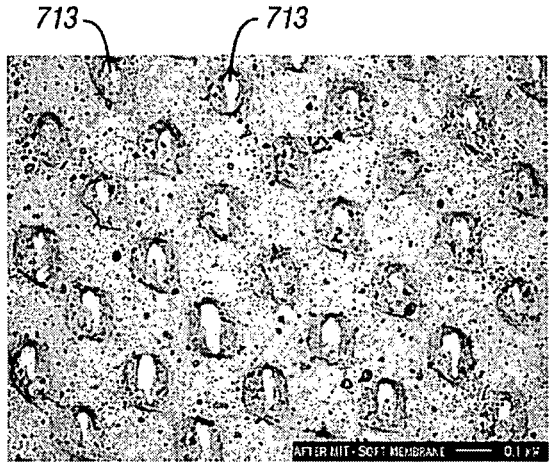
FIGS. 8*a*–8*b* are micrographs of ink screen printed onto a silicone membrane and a silicone membrane with subsequent transfer via a MIT process to a "hard" (polycarbonate) substrate.
Figure 8B:
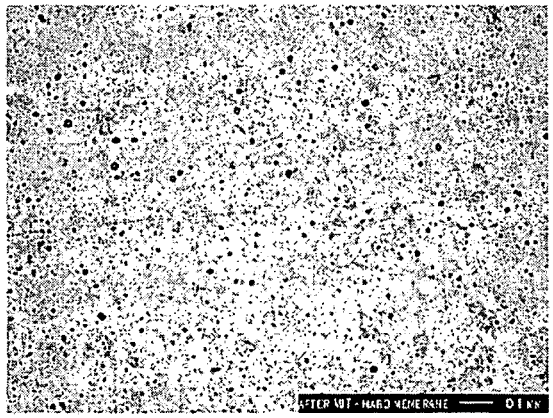

Screen printing an image onto a hard, fluorocarbon elastomer (THV, Dyneon Corp., St. Paul, Minn.) membrane was found not to exhibit any indication of the screen mesh lines as previously observed with softer membrane materials. This particular membrane exhibits a hardness value on the order of 44 durometer Shore D, which is approximately equivalent to 95 durometer, Shore A. Similar results were obtained for other membrane materials exhibiting hardness values greater than about 75 durometer, Shore A. For example, the subsequent transfer of a print from a silicone membrane (80–85 durometer, Shore A, Ja-Bar Silicone Corp.) to polycarbonate was found to produce a complete image without any indication of the screen mesh (e.g., transparent lines or holes) as shown in FIG. 8*b* versus FIG. 8*a* for a membrane with 60 durometer, Shore A hardness. Thus, the inventors have found that membrane hardness dominates the ability to screen print an image exhibiting total coverage or opacity. By increasing the hardness of the membrane, the effect that the surface energy exhibited by the membrane has on the final image can be relegated to the release of the ink from the membrane during the image transfer to a "hard" substrate.

The inventors have found that two specific types of "soft" membrane materials are preferred for use in a membrane image transfer process. These membranes consist of high molecular weight extruded or compression molded sheets of either a silicone or fluorosilicone elastomer. Specific examples of these membrane types include the extruded silicone sheet (SIL60) distributed by Kuriyama of America, Elk Grove Village, Ill., an extruded silicone sheet with a hardness of 80+durometer, Shore A (Ja-Bar Silicone Corp., Andover, N.J.), and the extruded fluorosilicone sheet (MIL-25988, type 2, class 1) manufactured by Jedtco Corp., Westland, Mich. These extruded sheets were found to provide exceptional performance characteristic in regards to ink transferability and compatibility with the application of an overcoat, such as a urethane coating or a silicone hard-coat system. An overcoat should be used to protect the printed image and overall plastic component from adverse effects due to exposure to various weather conditions and abrasive media (e.g., stone chips, scratches, normal wear and tear, etc.).

In a liquid, the attractive forces exerted by each molecule create an internal pressure that restrains the liquid from flowing or creating a new surface. This phenomenon, which is known as surface tension, is overcome in order for a liquid to flow over a surface. Surface tension is usually reported as a force per unit length (dynes/cm or mN/m). However, for liquids, this force per unit length is also equivalent to the excess free energy per unit area ($mJ/m^2$ or $erg/cm^2$) applied to create the new surface. In other words, energy is used to move molecules from the bulk of the liquid to create the new surface. Thus for liquids (e.g., inks), surface tension is equivalent to surface energy. This same equivalency does not hold for solid materials (e.g., membrane & substrate).

Since the molecules in a solid do not have the same mobility as those in a liquid, a solid is forced to exert energy to strain the surface to accommodate the formation of a new surface. Thus surface stress or tension in a solid will typically be larger than its surface energy. Due to the difficulty in measuring both surface stress and surface energy for solid materials, we are relegated to methods (e.g., contact angle, standardized liquids, etc.) that provide an estimate of the surface energy.

Figure 9:
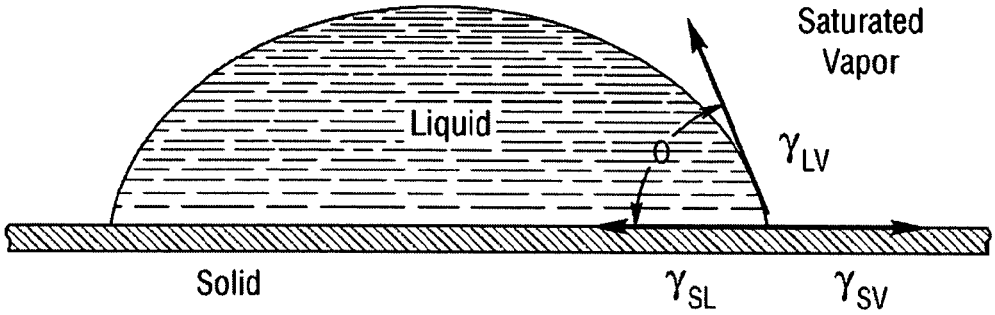
FIG. 9 is a schematic representation of Young's equation relating interfacial energy and contact angle.

When a liquid comes into contact with a solid, a relationship exists between the interfacial energy of the system and the contact angle (θ). This relationship is described by Young's Equation as shown in FIG. 9. When the liquid spreads onto the solid surface, thereby, increasing the solid-liquid interface, the inherent effect is a reduction in the solid-vapor interface.

The change in Gibbs free energy over an increase in area (dA) is approximated by the expression $(\gamma_{lv}+\gamma_{ls}-\gamma_{sv})dA$. When this change in free energy is negative, the liquid will spontaneous flow or spread over the surface of the solid. This concept is generally, expressed in terms of a spreading coefficient (S) as defined by Equation 1. In this case, a positive spreading coefficient is used for spontaneous spreading to occur.

$$S=\gamma_{sv}-(\gamma_{lv}+\gamma_{ls}) \quad \text{(Eq. 1)}$$

The interfacial energy of the solid-vapor interface can be estimated by the determination of a critical "wetting" tension for the solid through the use of standardized solutions as described in ASTM D2258-94. Solutions of known surface energy or tension were found to provide a linear relationship with the cosine of the contact angle made by the liquid on a substrate. Thus the surface tension of a liquid can experimentally be determined that will spontaneously "wet" the surface of the solid. Any liquid exhibiting a surface tension equal or less than this critical "wetting" tension would also spontaneously spread over the surface. This concept of critical "wetting" tension is mentioned because of its implication in determining the surface chemistry preferred for a membrane to be able to successfully transfer an ink in an MIT printing process. Surfaces whose structure predominately contains either —$CH_2$, —$CH_3$, —$CF_2$, or —$CF_3$ groups are known to those skilled in the art to exhibit critical "wetting" tensions on the order of 31, 22, 18, and 15 mN/m, respectively.

The presence of $S_1$—$CH_3$ functionality on the surface of a membrane consisting of silicone rubber provides a surface exhibiting a very low critical "wetting" tension. The low critical "wetting" tension exhibited by silicone rubber is the main property of the membrane that provides for good ink transfer. Thus the membrane should exhibit a critical "wetting" tension less than or equal to about 25 mN/m. This critical wetting tension limit is equal to the surface energy limit of less than or equal to about 25 $mJ/m^2$.

In addition to overall critical wetting tension or surface energy, the polarity of the surface provides that the adhesion energy between the membrane and ink are minimized, while the adhesion energy between the ink and plastic substrate are maximized. The surface polarity of the ink, membrane, and substrate can be determined by separating measured surface tension and surface energy values into polar and dispersive components as known to those skilled in the art.

According to Fowkes surface energy theory, the dispersive (non-polar) component of a liquid (e.g., ink) can be separated from its overall surface tension using the inks' contact angle against PTFE (non-polar surface) according to Equation 2. In theory, a liquid that exhibits a low contact angle on PTFE will exhibit a high level for the dispersive component of the surface tension.

$$\sigma_L^D = \frac{\sigma_L^2(\cos\theta_{PTFE}+1)^2}{72} \quad \text{(Eq. 2)}$$

In this equation, $\theta_{PTFE}$ represents the contact angle measured between PTFE and the liquid (e.g., ink), while the overall surface tension for the liquid is represented by $\sigma_L$. Thus the dispersive surface tension component ($\sigma_L^D$) exhibited by the liquid can be obtained by simple calculation according to Equation 2. The polar surface tension component ($\sigma_L^P$) for the liquid is then determined via the difference between the overall surface tension ($\sigma_L$) and the dispersive component ($\sigma_L^D$). The ratio of the polar component to the overall surface tension provides a measurement of the (%) polarity of the surface.

Similarly, the surface energy exhibited by a solid substrate ($\sigma_S$) can be obtained according to Fowkes energy theory, according to Equation 3. In this equation, $\sigma_S^D$ and $\sigma_S^P$ represent the dispersive and polar component of the surface energy exhibited by the solid. For the determination of $\sigma_S$, the use of two standard fluids are preferred, one of which exhibits only a dispersive component to its overall surface tension. In this situation, $\sigma_L^P$ goes to zero, while $\sigma_L$ equals $\sigma_L^D$. Thus $\sigma_L^D$ can be calculated directly from Equation 3 using the measured contact angle and surface tension data. Diiodomethane is usually used as the first standard fluid ($\sigma_L^P$ equals 0.0 mN/m). This standard fluid exhibits a surface tension value ($\sigma_L$ & $\sigma_L^D$) on the order of 50 mN/m.

$$(\sigma_L^D)^{1/2}(\sigma_S^D)^{1/2}+(\sigma_L^P)^{1/2}(\sigma_S^P)^{1/2}=\frac{\sigma_L(\cos\theta+1)}{2} \quad \text{(Eq. 3)}$$

The second standard fluid utilized is usually water exhibiting a surface tension ($\sigma_L$) of 70–75 mN/m, a dispersive component ($\sigma_L^D$) equivalent to about 25 mN/m and a polar component ($\sigma_L^P$) of about 50 mN/m. Utilizing the known surface tension values for this standard fluid along with the value for the dispersive component for the substrate's surface energy ($\sigma_S^D$) and the measured contact angle for water against the substrate, the value of the polar component ($\sigma_S^P$) can be obtained from Equation 3. The overall surface energy for the solid substrate is then simply the sum of the dispersive and polar components. The surface polarity of the substrate is usually given as the percentage of the polar component to the overall surface energy exhibited by the substrate.

In order to obtain the best transfer in the MIT process, the inventors have found it desirable to minimize the adhesion between the membrane and the ink (mismatch in surface polarity), while maximizing the adhesion energy between the ink and the substrate (similar surface polarity). Thus the surface polarity of ink should be greater than about 10% with the surface polarity of the membrane being less than about 2%. Similarly, the surface polarity of the substrate should be closer to the surface polarity of the ink, than the ink is to the membrane surface polarity. The surface polarity of the plastic substrate should be less than about 20%. A similarity in surface polarity between the ink and substrate will promote adhesion between the ink and the surface of the substrate.

The addition of silicone oil to the silicone rubber as is done in the pad printing industry for hardness modification has been shown to have very little effect on the surface energy or critical wetting tension of the membrane. However, the presence of low molecular weight silicone oil in the silicone rubber is undesirable because it can cause an issue with being able to apply a protective overcoat, such as a silicone hard-coat system, to the "hard" substrate. The transfer of a contaminant from the membrane to the surface of the "hard" substrate could alter the surface energy exhibited by the window, thereby, hindering the application of a protective overcoat.

All conventional silicone printing pads were found to decrease the critical wetting tension of a polycarbonate substrate from 42–45 mN/m upon contact to a value less than ~30 mN/m. Attempts to apply an overcoat consisting of an acrylic primer (SHP401, GE Silicones) and a silicone hard-coat (AS4000, GE Silicones) onto this polycarbonate substrate after being in contact with a silicone pad failed due to the formation of severe craters (e.g., fish-eyes). The leaching of low molecular weight silicone oil (linear & cyclic molecules) from the silicone pads to the substrate was identified as the source of surface contamination causing the formation of coating defects. Even conventional silicone pads sold as "dry" with little to no "free" silicone oil added for hardness modification was observed to cause a similar surface energy reduction and the formation of craters upon overcoat application.

Injection molded (IM) silicone and fluorosilicone materials subjected to a post-bake under vacuum were found to cause a substantial decrease in the critical wetting tension of polycarbonate. This affect was slightly lessoned by an additional attempt to remove low molecular weight impurities via the use of a chemical cleaning procedure (2 minutes of a toluene soak followed by a 45 minutes bake cycle at 50° C.). However, even in this case at the resulting critical wetting tension between 34–35 mN/m, the formation of craters was observed upon the application of an overcoat system to the polycarbonate substrate. Only one type of silicone and one type of fluorosilicone membrane material, namely, extruded sheets were found not to dramatically affect the critical wetting tension of polycarbonate and exhibit the capability of successfully being coated with a protective overcoat.

Figure 10A:
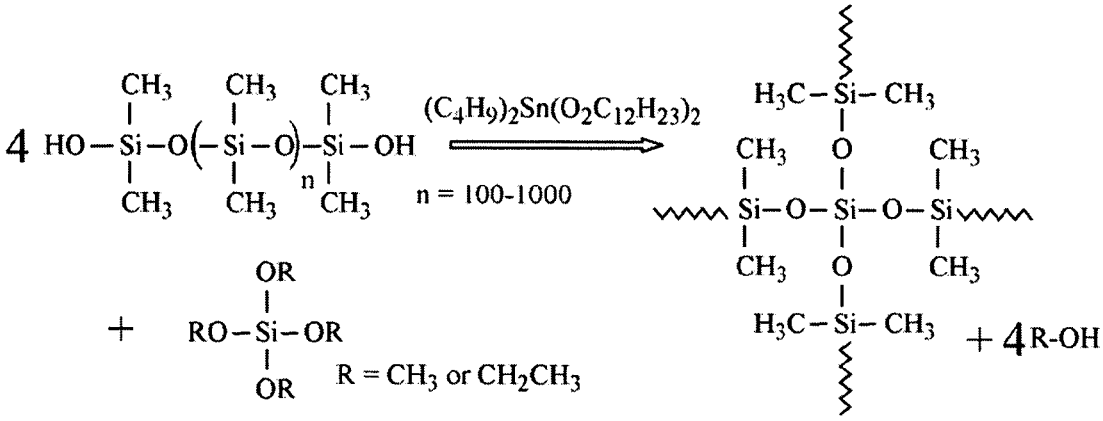
FIGS. 10*a*–10*b* depict stoichiometric formations of silicone rubber via both condensation and addition polymerization reactions.

Extruded silicone rubber membranes are comprised of high consistency silicone rubber elastomers formed through either condensation, free radical, or addition polymerization along with the addition of reinforcing (e.g., fumed silica, precipitated silica, etc.) and extending fillers (e.g, barium sulfate, titanium dioxide, etc.), as well as cure ingredients. The elastomer may consist of a single polymer type or a blend of polymers containing different functionalities or molecular weights. For example, in condensation polymerization, the hydroxyl end-groups present in the polydimethylsiloxane base resin are reacted with a cross-linking agent (see FIG. 10*a*). The preferred cross-linking agent is a methoxy- or ethoxy-functional silane or polysiloxane. The catalyzed condensation reaction occurs at room temperature with the elimination of an alcohol. Typical catalysts include both the amines and carboxylic acid salts of many metals, such as lead, zinc, iron, and tin.

Figure 10B:
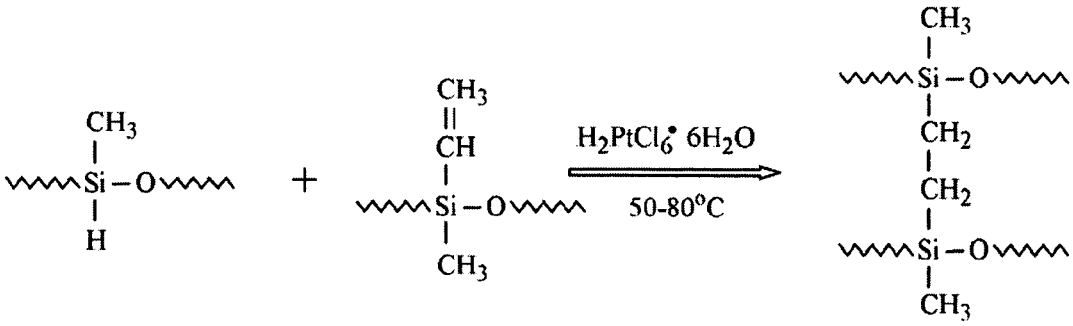

A free radical cure process utilizes catalysts, such as peroxides, that specifically interact with alkyl substituents in the polymer backbone. The peroxide catalyst (e.g., bis(2,4-dichlorobenzoyl) peroxide and benzoyl peroxide, among others) decompose upon the addition of heat to form free radical species that react with the backbone of the polymer. An addition cure mechanism involves the catalyzed addition of a silicon hydride (—SiH) to an unsaturated carbon—carbon bond in the functionality present in the polymer backbone as shown in FIG. 10*b*. The hydrosilyation catalyst is usually based on a noble metal, such as platinum, palladium, and rhodium. For example, chloroplatinic acid (see FIG. 10*b*) is one example of a hydrosilyation catalyst. The addition cure mechanism is the preferred mechanism for the formation of high consistency silicone rubber for use in a membrane material due to the absence of any by-products formed in the cure reaction.

High consistency silicone rubber elastomers are different from the liquid silicone rubber that is typically used for the injection molding of components. In general high consistency silicone rubber elastomers are typically millable as compared to pumpable for liquid silicone rubber. The degree of polymerization for high consistency silicone rubber is in the range of about 5,000 to 10,000 (number of repeating functional groups in polymer backbone) with a molecular weight ranging from about 350,000 to 750,000 amu. In comparison, the degree of polymerization in liquid silicone rubber is on the order of 10 to 1,000 exhibiting a molecular weight in the range of 750 to 75,000 amu.

Extruded fluorosilicone rubber suitable for the described embodiment can be manufactured through a process similar to that previously described for polydimethylsiloxane rubber. The substitution of methyl groups in the conventional silicone intermediates used for polydimethylsiloxane rubber production with fluorine containing organic groups, such as a trifluoropropyl group, provides the basic constituents preferred for the production of fluorosilicone rubber membranes with high consistency.

The solvent systems present in most ink systems, which typically include esters, ketones, and/or hydrocarbons, among others can be absorbed by "soft" low surface energy membranes. The inventors have found that fluorocarbon elastomers absorb more solvent, as characterized by both a weight gain and dimensional expansion (swelling), than do silicone rubber or fluorosilicone rubber. The swelling of the membrane constitutes a potential issue for the application of an ink and the use of a "soft" membrane in a MIT printing process. Primarily, the inventors identified that the swelling of the membrane manifests itself in a decrease in membrane hardness that affects the opacity and image quality of the applied print. This phenomenon is exasperated by the use of a very thin membrane (e.g., with a thickness less than or equal to about 0.16 cm or $1/16^{th}$ of an inch). This phenomenon was determined not to affect the surface of the "hard" substrate due to the leaching of any contaminants from the membrane to the surface of the substrate. In other words, the surface energy of the "hard" substrate is unaffected upon coming in contact with a solvent "swollen" membrane.

Figure 11:
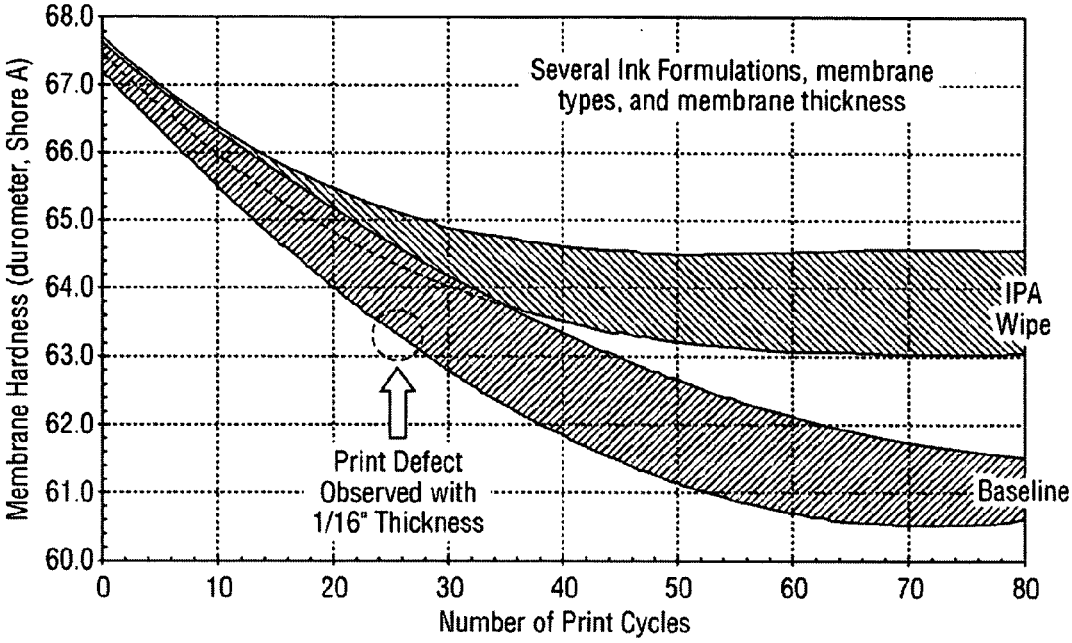
FIG. 11 is a plot of silicone membrane hardness versus the number of print cycles in accordance with one embodiment of the present invention.

Two methods were found to be useful in minimizing the decrease in hardness exhibited by the membrane during a continuous MIT printing process. These methods include the blowing of forced air over the surface of the membrane and/or wiping the surface with a solvent compatible with the membrane material. An example of a solvent compatible for use with a silicone membrane is an alcohol, such as isopropyl alcohol. The application of either of these cleaning methods was found to be preferred after the application of about every 5–15 prints. The use of the alcohol cleaning method was found to reduce the decrease in hardness exhibited by the membrane to at least 50% of the decrease observed without cleaning as shown in FIG. 11. The use of the two cleaning methods described above were found to be useful in providing an acceptable print quality even upon the application of 60+ continuous prints provided a membrane with a thickness greater than about 0.16 cm ($1/16^{th}$ of an inch) was utilized. The preferred membrane thickness for use in an MIT process for the application of a print to a polycarbonate window is on the order of about 0.32 to 0.64 cm ($1/8^{th}$ to $1/4^{th}$ of an inch).

Cleaning methods that were found to have little or no affect on reducing the swelling of the membrane included wiping the membrane with the solvent present in the ink and briefly heating the surface of the membrane to a temperature of 65° C. (150° F.). Over time the solvent absorbed into the membrane will evaporate, allowing the membrane to return to its original hardness. However, this restoration was observed to take greater than about 12 hours, which is unacceptable for productivity reasons (excessive equipment down-time). Thus blowing forced air across the surface of the membrane and/or periodically wiping the membrane's surface with a compatible solvent is preferred.

The following specific examples are given to illustrate the invention and should not be construed to limit the scope of the invention.

EXAMPLE 1

Ink Thickness Measurement via Interferrometry versus Profilometry

A total of seven flat materials of various compositions and properties as identified in Table 2 (Run #'s 1–7) were printed using conventional screen printing. The screen printing operation consisted of a standard screen printer (Saturn, M&R Screen Printing Equipment Inc.) equipped with a 65 durometer, Shore A squeegee and a 160 mesh screen. The different substrates consisted of two hardness ranges as exemplified by being either a "hard" thermoplastic, such as nylon, polycarbonate, ABS, and TPO, or a "soft" elastomer (rubber), such as a silicone and nitrile. The thickness of all substrates was held at a constant value. All substrates were printed simultaneously using identical printing conditions (e.g., applied force, transverse speed, flood time, etc.) and a black screen printable ink (Noriphan HTR-952+10 wt. % 097/003 retarder, Proell K G, Switzerland).

TABLE 2

| | | THICKNESS (micrometers) | |
|---|---|---|---|
| Hard Substrates | | | |
| 1 | polycarbonate | 8.6 | Makrolon 2647, Bayer AG, Germany |
| 2 | ABS | 7.7 | Polymer Laboratory, Eastern Michigan Univ. |
| 3 | TPO | 7.6 | Polymer Laboratory, Eastern Michigan Univ. |
| 4 | Nylon | 8.3 | Polymer Laboratory, Eastern Michigan Univ. |
| Soft Substrates | | | |
| 5 | silicone (SIL60) | 14.2 | SIL60, Kuriyama of America, Elk Grove Village, IL |
| 6 | nitrile (W60) | 9.9 | W60, Kuriyama of America, Elk Grove Village, IL |
| 7 | silicone (LIM6030) | 17.5 | LIM6030, GE Silicones, Waterford, NY |

A significant difference was observed in the step-height thickness of each print applied to a "hard" substrate (Run #'s 1–4) versus each print applied to a "soft" substrate (Run #'s 5–7) when measured by conventional profilometry. Profilometry is a suitable technique for "hard" substrates as shown by the similarity between measurements taken for ink deposited on several types of thermoplastic substrates (Run #'s 1–4). However, this technique measures a similar ink film deposited onto "soft" substrates as being much thicker as shown for the various elastomeric substrates in Run #'s 5–7. The profilometer (Dektak 8000, Sloan, a subsidiary of Vicker Industries) used to obtain these measurements applied a 1 mg force to a 12.5 $\mu$m conical stylus. The inventors believe that the stylus is pushed into the soft substrate under the applied force, thereby, causing the initial reference point or baseline to be depressed below the "true" surface of the membrane. The end result is the measurement of a larger step height to reach the surface of the deposited ink film. This effect is substantiated by the largest step height measurement (Run #7) being obtained for a membrane with the lowest hardness (30 durometer, Shore A) as compared to the other two membrane materials (Run #'s 5–6) exhibiting a hardness of 60 durometer, Shore A. This effect was found to be even further exaggerated upon using either a conical stylus with a smaller tip diameter (e.g., 2.5 □m tip) or by applying a greater force (e.g., maximum=20 mg) to the stylus. In both of these cases, the variation in the measured thickness of the print applied to the "soft" substrates was found to significantly increase.

Interferometry represents a non-contact method of measuring surface texture, roughness, and step height difference that provides a more accurate measurement of the print thickness than one can obtain using conventional profilometry. This technique utilizes the creation of an optical light/dark fringe pattern via constructive and destructive interference of white light reflected from the sample and reference targets to determine distances. A total of two polycarbonate substrates and two silicone elastomeric membranes as identified in Table 3 as Run #'s 8–11 were printed using conventional screen printing. The identical parameters as previously described above were utilized to screen print each sample with the exception that the mesh size of the screen was increased to 200 threads per inch.

TABLE 3

| | THICKNESS (micrometers) | |
|---|---|---|
| | Interferometry | Profilometry |
| Polycarbonate Substrate (Makrolon 2847, Bayer AG, Germany) | | |
| 8 | 7.8 | 7.6 |
| 9 | 7.1 | 7.2 |
| AVG | 7.5 | 7.4 |
| Silicone Membrane (SIL60, Kuriyama of America, Elk Grove Village, IL) | | |
| 10 | 6.8 | 11.3 |
| 11 | 7.5 | 12.6 |
| AVG | 7.2 | 11.9 |

Interferometry and profilometry were found to provide identical results with respect to step-height thickness for a print applied to a "hard" substrate. The average thickness of the print applied to polycarbonate in Run #'s 8 & 9 was measured via interferrometry (NewView™ 5022 3D profiler, Zygo Corporation, Middlefield, Conn.) to be 7.5 $\mu$m, which is nearly identical to the 7.4 $\mu$m thickness measured via profilometry for these same samples.

Interferrometry and profilometry were found to provide greatly different results for the step-height thickness of a print applied to a "soft" substrate. The inventors found that interferometry measured a less than 5% difference between the average thickness of the ink applied to a polycarbonate (Run #'s 8–9) substrate and a silicone (Run #'s 10–11) membrane. In comparison, a greater than 50% difference in ink thickness for these same samples (Run #'s 8–9 versus 10–11) was observed upon obtaining measurements via profilometry.

This example demonstrates that screen printing provides the deposition of a similar thickness of ink onto both "hard" (e.g., polycarbonate, etc.) and "soft" (e.g., silicone membrane, etc.) substrates. The variation in the ink thickness deposited on these substrates under similar conditions was found by interferometry to be less than 5%. The use of profilometry was found to provide a false measurement of thickness for ink deposited onto a "soft" substrate. In this case, an indentation via the stylus into the "soft" membrane is believed to increase the difficulty in establishing a "true" baseline.

Figure 4A:
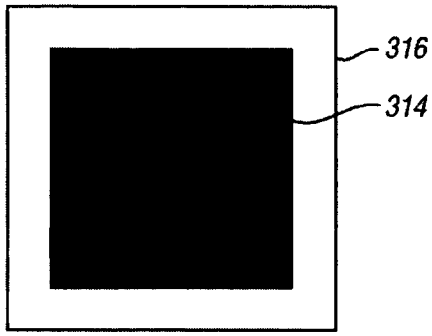
FIGS. 4*a*–4*b* is a perspective view of images screen printed onto a "hard" (polycarbonate) substrate and a "soft" (nitrile) membrane.
Figure 4B:
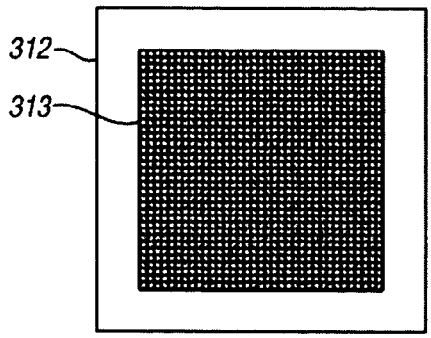

Although the thickness of the print on "hard" and "soft" substrates were nearly identical, the image quality exhibited by the print was vastly different as shown in FIG. 4. In the case of the print applied to a nitrile membrane (60 durometer, Shore A), an incomplete image pattern was observed. This incomplete pattern arose due to the inability of the ink to flow across the membrane to fill in the mesh lines left from the screen printing process. In comparison, the image applied to a polycarbonate substrate was found to exhibit 100% opacity with a solid or complete image pattern. Thus this example further demonstrates that the image quality of a print applied to a "soft", low surface energy membrane via screen printing is not as pronounced or distinct as the image quality exhibited by a print applied by screen printing onto a "hard" substrate with a surface energy higher than that exhibited by the ink.

The main differences between the membrane and substrate include both their hardness and surface energy values. The hardness of the polycarbonate is approximately 80 durometer, Shore D, while its critical wetting tension is on the order of 42–45 mN/m or dynes/cm as measured according to ASTM D2578-94. On the other hand, the hardness of the nitrile membrane is approximately 60 durometer, Shore A with a critical wetting tension on the order of 34–35 mN/m. Typical solventborne inks, such as the inks utilized in this experiment, exhibit a surface tension on the order of 27–35 mN/m. It is well known to those skilled in the art, that in order for a liquid, such as an ink, to completely "wet" the surface of a substrate, the magnitude of the surface tension exhibited by the liquid is preferred to be lower than the surface energy ("critical wetting tension") of the substrate by about 10 mN/m.

EXAMPLE 2

Laboratory and Production Prototype MIT Apparatus

Since interferometry in Example #1 established that the ink thickness deposited onto the soft membrane was comparable to that deposited via screen printing onto polycarbonate, the most cost effective test procedure would be to evaluate all printed images after MIT transfer from the soft membrane onto a polycarbonate substrate. Under these conditions, e.g., the MIT transfer of the print from the membrane to polycarbonate prior to testing, a conventional profilometer could be used to accurately determine the ink thickness values.

A laboratory scale, MIT apparatus was built in order to cost effectively evaluate both membrane materials (25.4×25.4 cm maximum size) and ink compositions, as well as to understand the fundamentals associated with the transfer of ink from the membrane to a polycarbonate substrate. This laboratory apparatus simulated the actual operation of full scale production MIT equipment. In this sense, a form fixture is raised to stretch the membrane into the shape of the fixture. The stretched membrane comes to rest at approximately 1–2 mm below the surface of a polycarbonate substrate (22.9×22.9 cm maximum size). The polycarbonate substrate, which is held in place by a part fixture, is then lowered and forced against the stretched membrane. The force applied between the substrate (part fixture) and the membrane (form fixture) is measured using a simple pressure/force meter (91 kg or 200 lbs maximum). This laboratory apparatus was utilized in subsequent experimental trials (see Example 3, etc.).

A full scale MIT production prototype apparatus was constructed according to the drawings and information provided in U.S. Patent Publication #2003-0116047 which is hereby incorporated herein. This production prototype apparatus is capable of printing onto plastic substrates, such as polycarbonate windows, up to a maximum size of about 0.5 $m^2$. The machine utilized a standard screen printer (Saturn, M&R Screen Printing Equipment Inc.) and a silicone membrane (60 durometer, Shore A, Kuriyama of America, Elk Grove Village, Ill.) to produce a print that is transferred to the interior surface of a polycarbonate window. This full scale MIT production prototype apparatus was utilized in subsequent experimental tests (see Example 6, etc.).

EXAMPLE 3

Screen Printing DOE using Laboratory MIT Apparatus

An initial Design of Experiment (DOE) was constructed as a replicated $2^2$ full factorial (Resolution V) design attempting to explore the relationships between squeegee hardness and applied force during screen printing of the Noriphan HTR-952 (Proell KG) ink system onto a silicone membrane (SIL60, Kuriyama of America). The experimental design is provided in Table 4 along with the data measured for ink thickness and image texture or quality. A total of 12 experimental runs were performed in order to include 4 midpoint runs (Standard Order #'s 9–12) used to determine curvature in the resulting model. The experimental error for these experiments is established through both the midpoint runs and through the replication of all runs (i.e., Standard Order #'s 1 and 2 utilize identical parameter settings). This entire experimental design was performed twice using a squeegee with a different angle (0° or 45°) as defined in FIG. 5.

The laboratory scale MIT apparatus constructed in Example 2 was utilized to transfer the print applied in each experimental run from the silicone membrane to a polycarbonate plaque. All MIT process variables were held constant throughout each experimental run. In this respect, the peel angle of the form fixture was held at 10°, the hardness of the form fixture at 35 durometer, Shore A, the contact time between the printed membrane and the polycarbonate substrate at 2 seconds, and the overall compression force applied between the membrane (form fixture) and substrate (part fixture) at 91 kilograms. In addition, the time between screen printing onto the membrane and the transfer of the print from the membrane to a polycarbonate substrate was also held constant at 30 seconds. All measurements regarding ink thickness and image quality or texture were performed on "hard" polycarbonate samples prepared by this method and cured according to the manufacturer's published recommendations.

squeegee against the screen. The inventors found that the quality of the print onto a "soft" membrane was very sensitive to the smallest adjustment in applied force (e.g., approximately ±0.25 turn or setting). Thus for each DOE the low & high force setting was taken to be ±0.5 turns from the optimum setting. The high and low hardness exhibited by the squeegee was set at 60 and 80 durometer, Shore A, respectively. Furthermore, in all experimental runs, the screen mesh, squeegee transverse rate, and screen flood time were held constant at 200 threads/inch, 25.4 cm/second, and 15 seconds, respectively. Due to the determination of the midpoint for applied squeegee force, the "off-contact" distance between the screen and the membrane was not considered as a process variable in this experiment. The midpoint for the applied squeegee force when determined according to the procedure above accounts for differences in "off-contact" distance that could be utilized by those skilled in the art.

The hardness of the squeegee and the applied force were found to both have a significant primary and secondary interaction with the thickness and image quality (texture) of the printed image when transferred from the membrane to a polycarbonate substrate. Similar results were obtained using a squeegee with either 0° or 45° angles. The measured data obtained for the DOE utilizing a squeegee with either 0° or 45° angles is provided above in Table 4. All of the measured results were analyzed using full ANOVA protocol, which is available in most standard statistical software packages, such as Design-Expert® (Stat-Ease Inc., Minneapolis, Minn.).

TABLE 4

| | | PROCESS VARIABLES | | RESPONSE DATA 0° Squeegee Angle | | RESPONSE DATA 45° Squeegee Angle | |
|---|---|---|---|---|---|---|---|
| Standard Order | Order Performed | Squeegee Hardness (durometer, Shore A) | Applied Force* | Ink Thickness (□m) | Image Texture (rating; 10 = high) | Ink Thickness (□m) | Image Texture (rating; 10 = high) |
| 11 | 1 | 70 | 0 | 5.6 | 8.50 | 4.7 | 7.25 |
| 8 | 2 | 80 | 0.5 | 4.2 | 6.50 | 10.3 | 5.50 |
| 12 | 3 | 70 | 0 | 6.1 | 7.50 | 5.3 | 7.00 |
| 10 | 4 | 70 | 0 | 4.6 | 7.00 | 3.8 | 7.50 |
| 1 | 5 | 60 | −0.5 | 6.0 | 6.00 | 9.7 | 6.10 |
| 5 | 6 | 60 | 0.5 | 4.2 | 6.00 | 8.3 | 4.50 |
| 9 | 7 | 70 | 0 | 5.5 | 6.50 | 4.5 | 7.00 |
| 4 | 8 | 80 | −0.5 | 8.2 | 3.00 | 9.5 | 3.25 |
| 7 | 9 | 80 | 0.5 | 4.2 | 8.00 | 9.5 | 5.25 |
| 6 | 10 | 60 | 0.5 | 3.5 | 5.50 | 9.0 | 4.25 |
| 2 | 11 | 60 | −0.5 | 6.2 | 5.00 | 7.9 | 6.00 |
| 3 | 12 | 80 | −0.5 | 7.8 | 3.00 | 11.2 | 3.50 |

*Applied Force = # of turns from established midpoint force

Each squeegee with a different angle (45° or 0°) exhibited a different midpoint force setting to obtain a desired print quality. More specifically, the midpoint force setting for a squeegee with an angle of 45° or 0° was found to be a setting of either 3.0 or 4.5 turns, respectively, on the squeegee pressure control bar of the Saturn screen printer. The midpoint force was established by determining the midpoint between where the applied print is either partially absent (not enough ink) or partially smeared (too much ink). The squeegee force is adjusted on this screen printer by turning this dial to a certain setting (minimum=0; maximum=15). This setting raises or lowers the vertical placement of the squeegee, thereby, altering the pressure applied by the The ANOVA analysis established that both squeegee hardness and applied force significantly affects the thickness of the applied print (e.g., opacity). For example, the DOE (0° squeegee angle) was modeled using the final equation shown below as Equation 4 having an adjusted R2 value of 0.908. The thickness of the deposited ink layer was found to reach a minimum when the applied force was 0.5 turns above the optimum setting as shown in FIG. 6*a*. This specific result was observed to be independent of the squeegee's hardness. Although the ink layer thickness was observed to increase at all squeegee hardness values as the applied force was decreased, the maximum affect was observed with a squeegee of high hardness (80 durometer, Shore A). As shown in the response surface (see FIG. 6*b*), a significant amount of curvature was encountered. Thus a squeegee with a low hardness and an applied pressure near the established midpoint is desired to provide an acceptable ink thickness.

$$\text{Thickness}=-5.60+0.29*\text{Hardness}+2.40*\text{Force}-0.07*\text{Hardness}*\text{Force} \quad \text{(Eq. 4)}$$

The image texture or quality exhibited by the printed ink image after MIT transfer from the membrane to polycarbonate was observed through the ANOVA analysis to also be significantly affected by both the applied force and squeegee hardness. For example, the DOE (0° squeegee angle) was modeled using a final equation shown below as Equation 5 having an adjusted R2 value of 0.944. An inverse transform was found to represent the best model for this response in both DOEs (45° & 0° squeegee angle). More specifically, the image quality was observed to improve as the applied force increased when a hard squeegee was used and deteriorate under similar force conditions when a soft squeegee was used (see FIGS. 7*a*–7*b*). Significant curvature was observed in both DOEs for this effect in regards to image texture. The response surface generated for this effect in the DOE using a squeegee with a 0° angle is provided in FIG. 4B as an example.

$$1.0/\text{imagequality}=-1.63+0.03*\text{Hardness}+0.55*\text{Force}-0.01*\text{Hardness}*\text{Force} \quad \text{(Eq.5)}$$

Using the response surfaces generated via the ANOVA analysis of each DOE (45° and 0° squeegee angle), the calculation of optimum parameter settings according to defined criteria (see Table 1) was performed. The optimization of ink layer thickness and image quality as described above using Design-Expert® software yielded several solutions exhibiting the specified level of image texture and ink layer thickness. Each solution was indicative of using a squeegee of low hardness and an applied force slightly below or near the midpoint value. Thus within the ranges evaluated in the DOEs described above, a low (<70 durometer, Shore A) hardness squeegee and the application of an applied pressure close to the determined midpoint setting (0.00±0.25 turns) is preferred.

In order to establish a baseline for image texture (quality), the inventors replicated the above screen printing DOE directly printing onto a "hard" polycarbonate substrate. All of the screen printing parameters as specified above were utilized in this experiment. The midpoint applied force was determined to be 7.0 and 9.5 turns from the established midpoint value for the squeegees having a 45° and 0° angle. The inverse of the image texture ratio for directly printing onto a "hard" substrate was determined via ANOVA analysis of the measured data to be between 0.10–0.13. The inventors unexpectedly found that in order to obtain useful results the inverse of image texture (1.0/image texture) criteria had to be relaxed from 0.10–0.13 to 0.17–0.20 when printing onto a "soft" membrane. Thus the screen printing onto a "soft" membrane followed by MIT processing provides a print of lower quality than that obtained by directly screen printing onto a "hard" substrate. Although the ink layer thickness present on a "soft" membrane is similar to that present on a "hard" substrate (see Example 1), the image quality is lower as exemplified by the occurrence of transparent lines and holes 713 left by the screen mesh (see FIG. 8*a* for an example). The end result for a print containing these transparent lines and holes is an unacceptable appearance and reduction in the final opacity exhibited by the applied print.

EXAMPLE 4

Image Quality Enhancement via Membrane Hardness

In Example 3, the image texture or print quality is observed to suffer upon the deposition of ink onto a "soft" substrate as compared to a "hard" substrate. In particular, the existence of small holes and transparent lines caused by the screen mesh vertices were identified in images printed on "soft" substrates (see FIG. 8*a*). This example demonstrates that the phenomenon as described above can be circumvented by increasing the hardness of the membrane from 60 durometer, Shore A to greater than about 70 durometer, Shore A.

More specifically, the inventors found that after screen printing an image onto a "semi-hard" (THV fluorelastomer, Dyneon Corp., St. Paul, Minn.) membrane, the print transferred using the laboratory scale apparatus (Example 2) was found not to exhibit any indication of the screen mesh lines as previously observed with softer membrane materials as shown in FIG. 8*b*. This particular membrane exhibited a hardness value on the order of 44 durometer Shore D, which is approximately equal to 95 durometer, Shore A. Similar results were obtained upon screen printing onto membranes of various compositions (e.g., silicone, and fluorosilicone, among others) that exhibited a hardness value greater than 70 durometer, Shore A. For example, the subsequent transfer of a print to polycarbonate from a silicone membrane (80 durometer, Shore A, Ja-Bar Silicone Corp.) was found to produce a complete image without any indication of the screen mesh (e.g., transparent lines or holes) as shown in FIG. 8*b*. Thus the hardness of the "soft" flexible membrane was found to dominate the ability to screen print an image exhibiting high image quality and opacity. The effect that the surface energy exhibited by the membrane has on the final image is therefore relegated to the release of the ink from the membrane during the image transfer to a "hard" substrate, such as polycarbonate.

EXAMPLE 5

Preferred Membrane Compositions

Eight conventional silicone pad formulations and sixteen different membrane materials were evaluated for their ability to be utilized in an MIT printing process. The membrane materials, which varied in composition, included representative samples of polydimethylsiloxanes, fluorosilicones, and fluorocarbon elastomers, as well as EPDM, nitrile, and neoprene among other rubbers. Any change in the critical wetting tension exhibited by a polycarbonate substrate was measured after the polycarbonate plaque came in contact with a membrane for approximately 10–15 seconds. The critical wetting tension of the polycarbonate substrate was determined via the procedure described in ASTM D2578-94. All process variables related to screen printing onto each membrane material and subsequent transfer of the print to a "hard" polycarbonate substrate (laboratory scale apparatus) were held constant through out this evaluation. In particular, the screen printing procedure utilized was the same as defined in Examples 1 and 3 with the laboratory scale MIT process being described in Examples 2 and 3. A detailed summary of the results of this evaluation is provided in Table 5.

All silicone printing pads used in conventional pad printing were found to decrease the critical wetting tension of polycarbonate from 42–45 dynes/cm (Run # 12) to less than 30 dynes/cm upon contact (Run #'s 13–20). Attempts to apply an acrylic primer and silicone hard-coat onto the polycarbonate substrate after being in contact with the silicone pads failed due to the formation of severe craters (e.g., fish-eyes). The leaching of silicone oil from the silicone pads to the substrate was determined through the use of infrared spectroscopy. Infrared spectroscopy was able to identify the Si—C and Si—O stretching vibrations known for low molecular weight silicone oil. Even conventional silicone pads sold as "dry" with little to no "free" silicone oil added for hardness modification was observed to cause a similar surface energy reduction and the formation of craters (see run #'s 16, 19, & 20) upon the application of a silicone hard-coat system.

Injection molded (IM) silicone materials subjected to a post-bake under vacuum were found to cause a substantial decrease in the critical wetting tension of polycarbonate (Run #'s 21–28). This affect was slightly lessoned (Run #'s 25–28) by an additional attempt to remove low molecular weight impurities via the use of a chemical cleaning procedure (2 minute toluene soak followed by a 45 minute bake at 50° C.). However, even at a critical wetting tension between 34–35 dynes/cm the formation of craters was observed upon the application of an over-coat to the polycarbonate substrate. Only one silicone membrane material, namely, an extruded sheet of high consistency silicone was found not to dramatically affect the critical wetting tension of polycarbonate and exhibit the capability of successfully being coated with a silicone hard-coat system as shown in Run # 36.

TABLE 5

| RUN # | MATERIAL DESCRIPTION | | CRITICAL WETTING TENSION (dynes/cm) | Acrylic (SMP401)/(AS4000) Silicone Application | Ink (I) Ink Transfer (%) | Ink (I) Image Rating | Ink (II) Ink Transfer (%) | Ink (II) Image Rating | Ink (III) Ink Transfer (%) | Ink (III) Image Rating |
|---|---|---|---|---|---|---|---|---|---|---|
| 12 | CONTROL (molded polycarbonate substrate) | | 42–46 | Good | — | — | — | — | — | — |
| | Conventional Printing Pads | | | | | | | | | |
| 13 | Silicone Pad, PMR-47 (40% oil added) | [a] | <30 | craters | — | — | — | — | — | — |
| 14 | Silicone Pad, CONTROL (20% oil added) | [a] | <30 | craters | 80 | 7 | 95 | 7.5 | 35 | 4 |
| 15 | Silicone Pad, T-73 (10% oil added) | [a] | <30 | craters | — | — | — | — | — | — |
| 16 | Silicone Pad, PMR-46 (0% oil added) | [a] | <30 | craters | — | — | — | — | — | — |
| 17 | Silicone Pad, S32250 (blue regular) | [b] | <30 | craters | — | — | — | — | — | — |
| 18 | Silicone Pad, S36250 (black regular) | [b] | <30 | craters | — | — | — | — | — | — |
| 19 | Silicone Pad, S362502 (black super dry) | [b] | <30 | craters | — | — | — | — | — | — |
| 20 | Silicone Pad, S322502 (blue super dry) | [b] | 32–34 | craters | — | — | — | — | — | — |
| | New Membrane Materials | | | | | | | | | |
| 21 | IM Silicone FDA grade, LIM6040-D2 (post baked) | [c] | <30 | craters | — | — | — | — | — | — |
| 22 | IM Silicone FDA grade, LIM6050-D2 (post baked) | [c] | <30 | craters | — | — | — | — | — | — |
| 23 | IM Silicone FDA grade, LIM6030 (post baked) | [c] | <30 | craters | — | — | — | — | — | — |
| 24 | IM Silicone FDA grade, LIM6071 (post baked) | [c] | <30 | craters | — | — | — | — | — | — |
| 25 | IM Silicone FDA grade, LIM6050-D2 (post baked)** | [c] | 34–35 | craters | — | — | — | — | — | — |
| 26 | IM Silicone FDA grade, LIM6040-D2 (post baked)** | [c] | <30 | craters | — | — | — | — | — | — |
| 27 | IM Silicone FDA grade, LIM6071 (post baked)** | [c] | 34–35 | craters | — | — | — | — | — | — |
| 28 | IM Silicone FDA grade, LIM6030 (post baked)** | [c] | <30 | craters | — | — | — | — | — | — |
| 29 | IM Fluorosilicone (FSL 7210) | [c] | 35–36 | wet-out | 95 | 7.5 | — | — | — | — |
| 30 | IM Fluorosilicone (FSE 7520) | [c] | 38–39 | wet-out | 95 | 7.5 | — | — | — | — |
| 31 | IM Fluorosilicone (FSE 7540) | [c] | 36–37 | wet-out | 90 | 7.5 | — | — | — | — |
| 32 | IM Fluorosilicone (FSE 7560) | [c] | 38–39 | wet-out | 90 | 7.5 | — | — | — | — |
| 33 | Fluorosilicone Sheet, MIL25988 type 2 class 1 | [d] | 35–36 | GOOD | 90 | 7.5 | 60 | 7.5 | 20 | 3.5 |
| 34 | Fluorocarbon Elastomer Sheet, Viton (black) | [e] | 42–43 | GOOD | 25 | 2 | 50 | 6.5 | 20 | 2.5 |
| 35 | Fluorocarbon Elastomer Sheet, Viton (black) | [f] | 44–45 | GOOD | 75 | 5 | 50 | 6.5 | 35 | 5 |
| 36 | Silicone sheet, SIL60 | [g] | 37–38 | GOOD | 85 | 7.5 | 90 | 7 | 35 | 4.5 |
| 37 | Nitrile sheet, FDA grade, W60 | [g] | 34–35 | GOOD | 75 | 7.5 | 70 | 7 | 35 | 3.5 |
| 38 | EPDM sheet, E60 | [g] | 39–40 | GOOD | 20 | 2 | 50 | 6.5 | 20 | 3.5 |
| 39 | Neoprene sheet, N60 | [g] | 45–46 | GOOD | 35 | 2 | 50 | 6.5 | 20 | 3 |
| 40 | EPDM sheet | [h] | 37–38 | GOOD | 55 | 6 | 50 | 7.5 | 15 | 3.5 |

**Test repeated after additional cleaning procedure followed: soaked in toluene for 2 minutes, then baked at 50 C. for 45 minutes

[a] Service Tectonics Inc., Adrian, Michigan; [b] Trans Tech of America Inc., Carrol Stream, Illinois; [c] GE Silicones, Waterford, New York; [d] Jedtco Corp., Westland, Michigan; [e] Daemar Inc., Savannah, Georgia; [f] James Walker, Glenwood, Illinois; [g] Kurlyama of America Inc., Elk Grove Village, Illinois; [h] Bayer Inc. (Rubber Division), Samia, Ontario, Canada Ink (i) = HTR-952 black with 10 wt. % 097/003 retarder, Proell GmbH, Switzerland; Ink (ii) = HG-N501 with 10 wt. % XX retarder, Coates Screen, St. Charles. IL; Ink (iii) = DTX-0638 UV black ink. Coates Screen, St. Charles. IL Fluorosilicone rubber (Run #'s 29–33), fluorocarbon elastomers (Run #'s 34 & 35), nitrile rubber (Run # 37), EPDM rubber (Run #'s 38 & 40), and neoprene rubber (Run # 39) were also found not to dramatically affect the critical wetting tension exhibited by polycarbonate. Substrates after being in contact with these membranes, all of which are extruded sheets (Run #'s 33–40), were found to be capable of being over-coated with an acrylic primer & silicone hard-coat system. Polycarbonate substrates after being in contact with injection molded fluorosilicone rubber (Run #'s 29–32) were found to exhibit a "wet-out" issue upon the subsequent application of the acrylic primer. This phenomenon suggests that the composition of the membrane material as it relates to the processing methodology used to create a sheet of the material is a critical parameter that will affect the ability of the membrane to perform in an MIT printing process.

Three conventional screen printing ink formulations were used to establish the ability of various membrane materials to transfer a print to polycarbonate. These screen printing inks consisted of two thermal cure systems represented by a polycarbonate resin-based formulation (HTR-952, Proell Gmbh), an acrylic PVC resin-based formulation (HG-N501, Coates Screen), as well as one radiation curable, acrylate system (DTX-0638, Coates Screen). Only membrane materials that did not dramatically affect the critical wetting tension of polycarbonate (Run #'s 29–40) were evaluated for ink transfer capability. As a control, one run (Run # 14) using a conventional pad-printing pad, which caused a dramatic reduction in the critical wetting tension of polycarbonate was also tested. The extruded silicone (Run # 36) and fluorosilicone (Run #'s 29–33) membrane materials were found to provide ink transfer and an image quality upon transferring to a polycarbonate substrate similar to that obtained with a conventional printing pad (Run # 14). In all cases, the ink was transferred from the membrane to polycarbonate immediately after being screen printed onto the membrane. The other membrane materials (Run #'s 37–40) failed due to their high surface energy characteristics in comparison to the $S_1$—$CH_3$ and Si—$(CH_2)_3CF_3$ functional groups in the silicone and fluorosilicone materials, respectively. The fluorocarbon elastomers (Run #'s 34 & 35) failed due to the ability of these membranes to split the ink layer between the membrane and the substrate during transfer. In other words, both the membrane and substrate exhibited the same image after transfer was completed.

The image quality rating is a subjective number (10=best, 0=worst) arrived at by considering the presence of pinholes, incomplete transfer (homogeneous vs localized), presence of a shadow, and loss of detail. No membrane material was found capable of transferring an acceptable image using a typical UV curable ink. Extruded sheets of silicone (Run # 36), fluorosilicone (Run #33) and nitrile rubber (Run #37), as well as injection molded fluorosilicone (Run #29–32) and a conventional silicone pad (Run #14) exhibited the highest image quality rating with thermal curable inks.

This example demonstrates that two membrane materials, namely, an extruded sheet of high consistency silicone and an extruded fluorosilicone sheet exhibit acceptable performance characteristics. In particular, these two types of membrane materials exhibit exceptional ink transferability to a "hard" substrate without affecting the quality of a protective overcoat, such as a silicone hard-coat, subsequently applied to the substrate. This example further demonstrates that injection moldable grades of silicones and fluorosilicones are not acceptable for use as a membrane in an MIT process where the substrate will be subjected to the application of a protective overcoat.

EXAMPLE 6

Screen Printing DOE using Production Prototype Apparatus

A Design of Experiment (DOE) was constructed as a $2^{(12-8)}$ fractional factorial (Resolution III) design with a full fold-over making it a Resolution IV design. This DOE attempted to explore the relationships between both screen printing (screen mesh count, squeegee hardness, squeegee applied force, and time flooded) and MIT transfer (print to transfer time, image transfer pressure, and image transfer time) process variables, as well as several ink composition variables (dispersant wt. %, solvent wt. %, resin ratio, catalyst wt. %, and opacity enhancer wt. %). All other possible variables were held constant (e.g., membrane hardness, squeegee transverse rate, and squeegee angle, among others). Responses selected to be measured on the print after being transferred to polycarbonate included visual defects, such as edge quality, image clarity, and pinhole existence, percentage of ink transferred, and ink thickness (opacity). The ink utilized in this Example consisted of a mixture of a polycarbonate resin and a polyester resin with an isocyanate catalyst and an opacity enhancing pigment in a mixed ester/hydrocarbon solvent system as described in U.S. Patent Application Publication No. US2003/0116047A1, filed Dec. 19, 2002. The membrane utilized was a 65 durometer, Shore A silicone membrane (SIL60, Kuriyama of America). The squeegee angle of 0° was utilized in all experimental runs. A total of 38 experimental runs were performed in order to include 6 midpoint runs, which were used to determine experimental error and curvature in the resulting model for each measured response. The experimental design is provided in Table 6.

The low-high range for the screen printing process variables included in this DOE were 200–260 threads/inch for screen mesh count, −2 & +2 turns around the established midpoint for applied squeegee force, 60–80 durometer, Shore A for squeegee hardness, and 10–50 seconds for screen flood time. The midpoint for applied hardness was determined by the procedure defined in Example 3. For the tests performed in this DOE, the established midpoint for applied squeegee pressure was a full 2.0 turns on the squeegee pressure control bar of the Saturn screen printer.

TABLE 6

| Standard Order | Order Run | Screen Mesh (threads per inch) | Applied Force above midpoint | Squeegee hardness (durometer, Shore A) | Screen Flood Time (seconds) | Print to Transfer Time | Image to Transfer Time | Image Transfer Force | Solvent wt. % | Catalyst wt. % | Dispersant wt. % | Opacity Enhancing Filler wt. % | Resin Ratio |
|---|---|---|---|---|---|---|---|---|---|---|---|---|---|
| 17 | 1 | 0 | 0 | 0 | 0 | 0 | 0 | 0 | 0 | 0 | 0 | 0 | 0 |
| 1 | 2 | − | 0 | − | − | + | + | + | + | + | − | − | + |

TABLE 6-continued

| Standard Order | Order Run | Screen Mesh (threads per inch) | Applied Force above midpoint | Squeegee hardness (durometer, Shore A) | Screen Flood Time (seconds) | Print to Transfer Time | Image to Transfer Time | Image Transfer Force | Solvent wt. % | Catalyst wt. % | Dispersant wt. % | Opacity Enhancing Filler wt. % | Resin Ratio |
|---|---|---|---|---|---|---|---|---|---|---|---|---|---|
| 4 | 3 | + | + | − | − | + | − | − | − | − | + | + | + |
| 9 | 4 | − | 0 | − | + | + | + | + | − | − | + | + | − |
| 18 | 5 | 0 | 0 | 0 | 0 | 0 | 0 | 0 | 0 | 0 | 0 | 0 | 0 |
| 6 | 6 | + | 0 | + | − | − | + | − | − | + | − | + | + |
| 15 | 7 | − | + | + | + | − | − | + | − | + | − | + | − |
| 12 | 8 | + | + | − | + | + | − | − | + | + | − | − | − |
| 7 | 9 | − | + | + | − | − | − | + | + | − | + | − | + |
| 14 | 10 | + | 0 | + | + | − | + | − | + | − | + | − | − |
| 10 | 11 | + | 0 | − | + | − | − | + | + | − | − | + | + |
| 13 | 12 | − | 0 | + | + | + | − | − | − | − | − | − | + |
| 19 | 13 | 0 | 0 | 0 | 0 | 0 | 0 | 0 | 0 | 0 | 0 | 0 | 0 |
| 8 | 14 | + | + | + | − | + | + | + | − | − | − | − | − |
| 11 | 15 | − | + | − | + | − | + | − | − | + | + | − | + |
| 16 | 16 | + | + | + | + | + | + | + | + | + | + | + | + |
| 5 | 17 | − | 0 | + | − | + | − | − | + | + | + | + | − |
| 2 | 18 | + | 0 | − | − | − | − | + | − | + | + | − | − |
| 3 | 19 | − | + | − | − | − | + | − | + | − | − | + | − |
| 31 | 20 | − | 0 | + | − | − | + | + | − | − | + | + | + |
| 28 | 21 | + | + | + | − | − | − | − | + | + | − | − | + |
| 36 | 22 | 0 | 0 | 0 | 0 | 0 | 0 | 0 | 0 | 0 | 0 | 0 | 0 |
| 23 | 23 | − | 0 | + | + | − | + | + | + | + | − | − | − |
| 34 | 24 | + | 0 | − | − | + | + | − | + | − | + | − | + |
| 25 | 25 | − | + | − | + | + | − | + | + | − | + | − | − |
| 26 | 26 | + | 0 | − | + | + | + | − | − | + | − | + | − |
| 33 | 27 | − | + | − | − | + | − | + | − | + | − | + | + |
| 37 | 28 | 0 | 0 | 0 | 0 | 0 | 0 | 0 | 0 | 0 | 0 | 0 | 0 |
| 20 | 29 | + | + | + | + | − | − | − | − | − | + | + | − |
| 27 | 30 | − | 0 | − | + | − | − | − | + | + | + | + | + |
| 30 | 31 | + | 0 | + | − | + | − | + | + | − | − | + | − |
| 35 | 32 | − | 0 | − | − | − | − | − | − | − | − | − | − |
| 21 | 33 | − | + | + | + | + | + | − | + | − | − | + | + |
| 38 | 34 | 0 | 0 | 0 | 0 | 0 | 0 | 0 | 0 | 0 | 0 | 0 | 0 |
| 32 | 35 | + | + | − | − | − | + | + | + | + | + | + | − |
| 29 | 36 | − | + | + | − | + | + | − | − | + | + | − | − |
| 22 | 37 | + | − | + | + | + | − | + | − | + | + | − | + |
| 24 | 38 | + | + | − | + | − | + | + | − | − | − | − | + |

+ = High Value; 0 = Midpoint Value; − = Low Value

An ANOVA analysis performed with conventional statistical software (Design-Expert®, StatEase Inc., Minneapolis, Minn.) was used to determine the significant process variables affecting image or print quality, ink thickness (opacity) of the transferred print, and ink transferability from the "soft" membrane to a "hard" substrate. More specifically, the inventors found that each of the process variables, namely, screen mesh count, squeegee pressure (force), squeegee hardness, and screen flood time impacted one or more of the measured responses. More specifically, the screen mesh, the screen flood time, and squeegee hardness were found to affect the thickness of the deposited print. In addition, the squeegee hardness and applied squeegee force were found via an additional measurement technique to be significant contributors to the overall opacity of the applied print. The applied squeegee force was further found to affect the ability to transfer the ink from the membrane to the substrate, while the squeegee hardness affected the overall quality (texture) of the image.

Figure 12A:
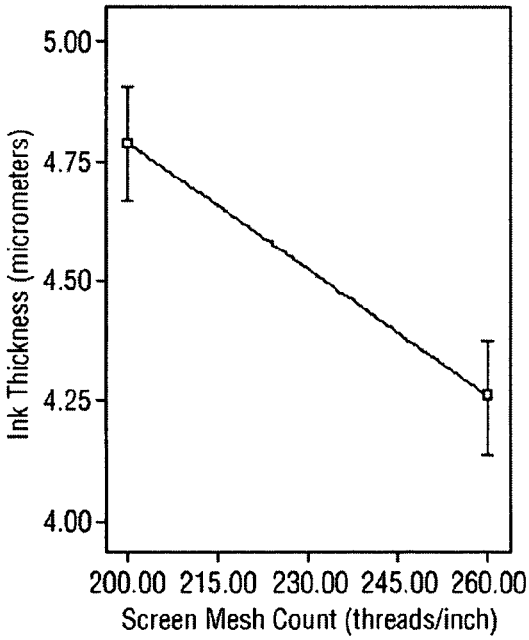
FIGS. 12*a*–12*b* are plots that depict interaction curves obtained in a design of experiment, indicating the affect of screen mesh count and time flooded have on the thickness of the ink layer.
Figure 12B:
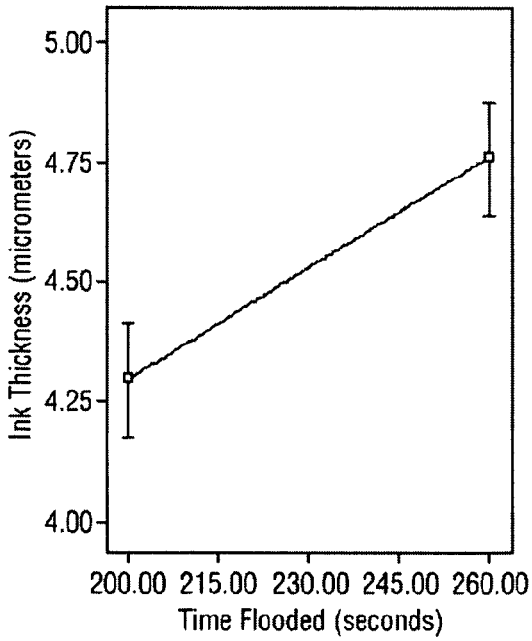

The thickness of the print applied in each experimental run (see Table 6) to a membrane with subsequent transfer to a polycarbonate window was measured via the use of profilometry as described in Example 1. As shown in FIGS. 12*a*–12*b* the thickness of the ink was significantly affected by both the screen mesh (FIG. 12*a*) and the amount of time the screen was flooded (FIG. 12*b*). The ANOVA analysis indicates that in order to insure that the preferred ink thickness (e.g., 4.0 and 10.0 μm) for both opacity and adhesion, the screen mesh should be less than 230 threads per inch. At this mesh count the ink thickness is approximately 4.5 μm with screens of lower mesh count being higher. Utilization of a screen with a higher mesh count begins to approach the lower thickness limit of 4.0 μm. A process operated near either the low or high specification limit will inherently create a significant amount of scrap due to the statistical distribution of parts exhibiting measurements around the limit. Similarly, the amount of time that the screen is flooded is preferably about or greater than 30 seconds in order to achieve the preferred ink thickness. The thickness of the ink when the flood time is 30 seconds was found to be about 4.5 μm. In order to have a robust process the MIT equipment preferably utilizes a screen with a mesh count less than or equal to 230 threads per inch and a flood time of about 30 seconds or greater.

Figure 13A:
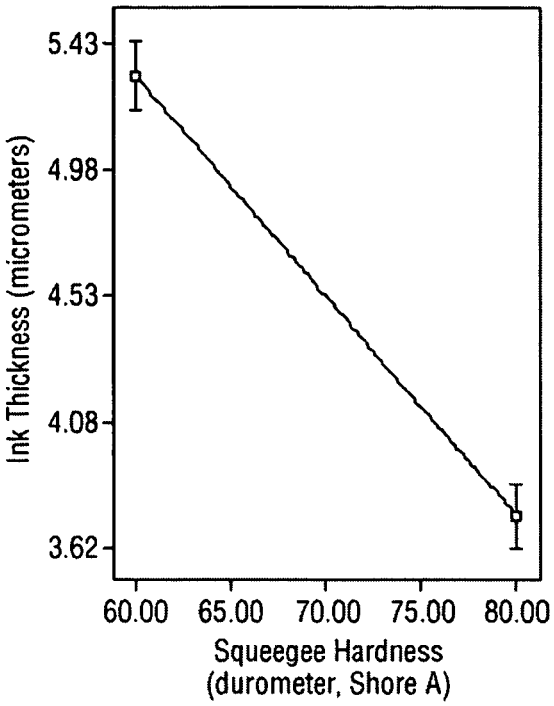
FIGS. 13*a*–13*b* are plots that depict interaction curves obtained in a design of experiment, indicating the affect squeegee hardness has on the thickness and the opacity of the ink layer.
Figure 13B:
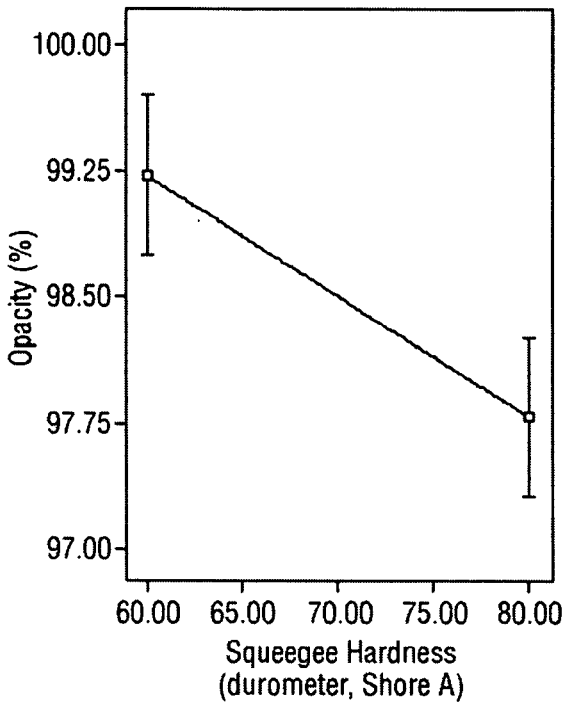

The thickness of the applied print was also found to be affected by the hardness of the squeegee. As shown in FIGS. 13*a*–13*b*, a direct correlation between the thickness of the print and the opacity of the print was observed. At a squeegee hardness of 70 durometer, Shore A, the thickness of the applied print was found to be approximately 4.5 μm (FIG. 13*a*). As the hardness of the squeegee is increased, the thickness of the applied print is observed to decrease. In order to have a robust process the MIT equipment utilizes a squeegee (0° or 45° angle) having a hardness value of about 70 durometer, Shore A or lower.

The opacity of each applied print was directly measured via a light transmission measurement adequately described in ASTM D001. As shown by comparison of FIGS. 10A & B, a direct correlation between ink thickness and opacity exists. The opacity of the printed image is observed (FIG. 13*b*) to decrease as the hardness of the squeegee is increased in a similar fashion to the decrease observed with ink thickness over the same squeegee hardness range.

Figure 14A:
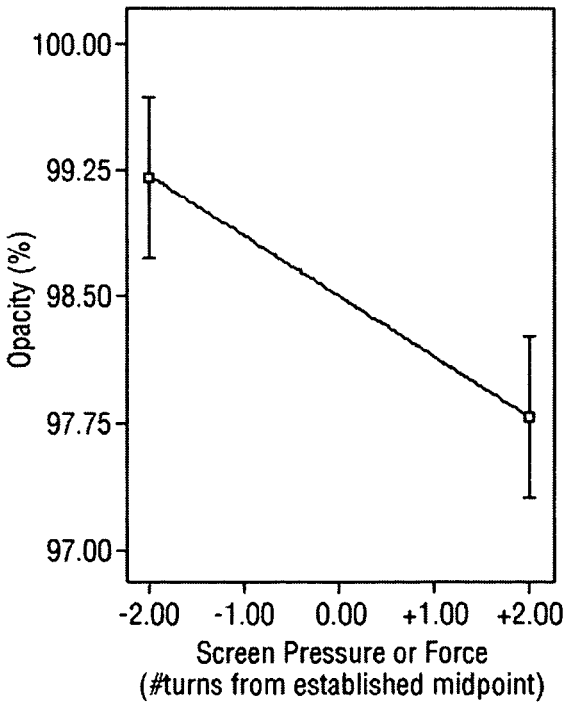
Figure 14A:
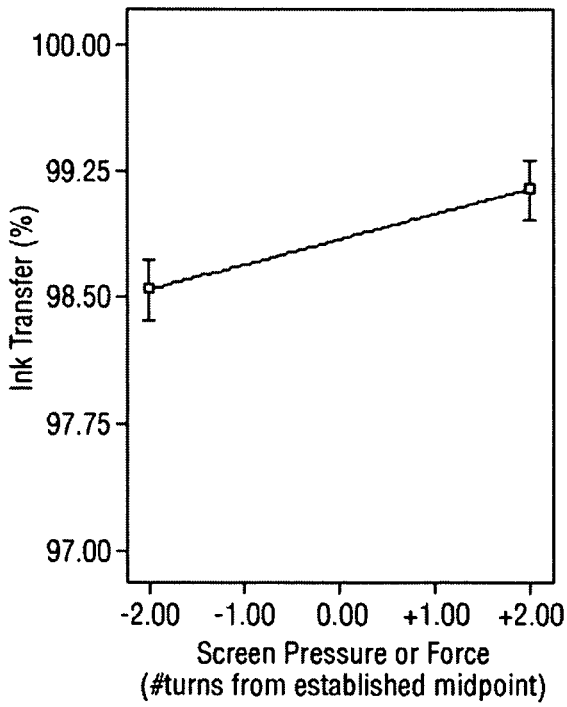

The applied squeegee force was found to also affect the opacity of the applied print. As shown in FIG. 14*a*, the opacity of the applied print increases as the applied force of the squeegee is decreased. However, one is not able to utilize a low applied squeegee force (pressure) because this process variable also was found to affect another key response, namely, the transfer of the ink from the membrane to the substrate. As shown in FIG. 14*b*, the percentage of ink transferred decreases as the applied squeegee force is lowered. Ink that does not transfer can cause two difficulties with the utilization of an MIT process. The lack of ink transferred to a part can result in an observable print defect. In addition, the ink remaining on the membrane may lead to the necessity of cleaning the membrane after each print, thereby, decreasing productivity (longer cycle times) and increasing cost. Thus this process variable is preferably operated near the established midpoint with about +/−0.5 turns being acceptable. Operation of the applied squeegee force in this range provides a balanced compromise between opacity and ink transferability.

Figure 15:
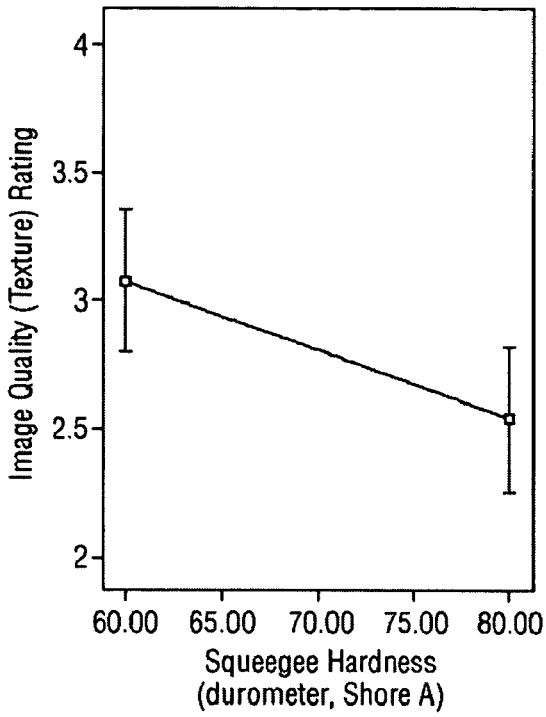
FIG. 15 are plots that depicts the interaction curve obtained in a design of experiment, indicating the affect that squeegee hardness has on the quality of the print transferred.

The image quality rating in this Example is a subjective number (10= best, 0=worst) arrived at by considering the presence of pinholes, edge quality, image clarity, and other visual defects (e.g., presence of a shadow and transparent lines, among others). The hardness of the squeegee was found by the inventors to be the key screen printing variable affecting the quality of the image applied to a "soft" membrane and subsequently transferred to a "hard" substrate. As shown in FIG. 15, the quality of the image increases as the hardness of the squeegee decreases. The squeegee hardness should be kept at or below about 70 durometer, Shore A to enhance the resulting image quality.

EXAMPLE 7

Contamination from Standard Pad Printing Tampons

Four conventional silicone pad printing tampons (colors equal white, blue, red, and grey) in four different hardness ranges were evaluated for their ability to be utilized in an MIT printing process. These tampons are commercially available products offered by Comec Pad Printing Machinery of Vermont, Incorporated. The hardness range for each tampon was modified by the addition of low molecular weight silicone oil during the production (e.g., molding) of the tampon. The addition of silicone oil to decrease the hardness exhibited by a tampon is common practice in the pad printing industry. Conventional transfer tampons are comprised of molded silicone rubber formed through either condensation or addition polymerization of low molecular weight silicone materials.

For each tampon a total of four experiments were conducted at the temperatures indicated in Table 7. In every experiment or run the tampon and three polycarbonate plaques were equilibrated at the indicated temperature for 30 minutes. Each tampon and plaque was then brought in contact with one another. A roller with the weight of 4.5 kilograms was moved back and forth across the back surface of the tampon for 15 seconds to simulate a pad printing process. The tampon was then removed from the surface of the plaque using a horizontal (peel) motion.

Out of the set of three plaques used in every experiment or run, one plaque was used to determine a critical surface ("wetting") tension through the use of standardized solutions. The other two plaques were then dip coated with an acrylic primer (SHP401, GE Silicones) and a silicone hard-coat (AS4000, GE Silicones) to determine the occurrence of any coating defects and/or loss of adhesion. The primer/hard-coat system was cured after a 30 minute flash-off for one hour at 120° C.

TABLE 7

| | Pad Color | Hardness Durometer (Shore A) | Critical "Wetting" Tension (dynes/cm) |
|---|---|---|---|
| Run #41 | white | 25–30 | 30–32 |
| tampon = 21.7° C. | blue | 55–60 | 32–34 |
| plaque = 21.7° C. | red | 65–70 | 32–34 |
| | grey | 75–80 | 34–36 |
| Run #42 | white | 25–30 | 30–32 |
| tampon = 21.7° C. | blue | 55–60 | 32–34 |
| plaque = 65.6° C. | red | 65–70 | 32–34 |
| | grey | 75–80 | 34–36 |
| Run #43 | white | 25–30 | <30 |
| tampon = 65.6° C. | blue | 55–60 | <30 |
| plaque = 21.7° C. | red | 65–70 | <30 |
| | grey | 75–80 | 30–32 |
| Run #44 | white | 25–30 | <30 |
| tampon = 65.6° C. | blue | 55–60 | <30 |
| plaque = 65.6° C. | red | 65–70 | <30 |
| | grey | 75–80 | 30–32 |
| Control | X | X | 42–44 |

The critical "wetting" tension exhibited by polycarbonate unexposed to a silicone rubber tampon was observed to be within the range of 42–44 dynes/cm as shown in Table 7 (control). Upon exposure to a silicone tampon the surface energy of the polycarbonate plaques were found to decrease. The magnitude of this decrease was dependent upon both the amount of silicone oil in the formulation (as indicated by hardness durometer) and the temperature of the tampon. In each experiment or run (temperature kept constant) the largest decrease in critical "wetting" tension was encountered for the softest tampon (white), which contains the most silicone oil. The smallest decrease in critical "wetting" tension was observed for the hardest tampon (grey), which contains the least amount of silicone oil. Thus silicone oil can be transferred from the tampon onto the surface of the polycarbonate substrate, thereby, lowering its surface energy.

The similarity in measurements obtained between Run #'s 41 and 42, as well as between Run #'s 43 and 44 indicates that the temperature of the plaque does not significantly influence the critical "wetting" tension results. However, when Run #'s 41 & 42 are compared against Run #'s 43 & 44, the temperature of the tampon is seen to affect the surface energy exhibited by the polycarbonate. In all cases, the critical "wetting" tension of the polycarbonate plaque decreased as the tampon temperature increased. As the temperature increases, the mobility of silicone oil via a decrease in viscosity (an increase in entropy) becomes enhanced.

The presence of a silicone impurity was confirmed through the use of Fourier Transform Infrared Spectroscopy (FTIR). The spectrum obtained for a polycarbonate plaque exposed to a silicone tampon was found to contain several absorptions indicative of polydimethylsiloxane. In particular, the asymmetric Si—O—Si stretching vibration is observed at 1050–1150 $cm^{-1}$. This stretching vibration gives rise to a significant change in dipole moment leading to a very strong and intense absorption in the infrared region. A second strong absorption centering around 802 $cm^{-1}$ was also observed. This absorption is caused by a combination of a Si—C stretching vibration and the —$CH_3$ rocking motion.

All plaques exposed to each of the four silicone tampons were found to exhibit coating defects after the application of the acrylic primer and silicone hard-coat indicative of the presence of silicone oil on the surface of the polycarbonate. In general, the magnitude of surface defects was observed to increase as the surface energy of the polycarbonate decreased (see Table 7). Typical defects that were encountered upon coating application included lack of "wetting-out" the substrate's surface and the formation of craters or fish eyes. A fish-eye is a form of crater (bowl shaped depression) distinguishable by a coated center region surrounded by a depression and a coating ridge. These type of defects are well known by those skilled in the art to be caused by surface contamination of the substrate being coated.

This example demonstrates that conventional silicone tampons are not adequate for utilization in a MIT process where a protective over-coat will subsequently be supplied. The silicone rubber utilized in the production of these tampons is a "molding" grade and not the high consistency grade indicated in the preferred embodiment.

EXAMPLE 8

Measurement of Surface Energy and Surface Tension

The average surface tension of a preferred MIT process ink as described in U.S. Patent Application Publication No. U.S. 2003/0116047A1, filed Dec. 19, 2002, which is incorporated herein, was measured five times using a conventional Wilhelmy plate method. This method utilizes a tensiometer (K100, Krüss USA, Charlotte, N.C.) equipped with a standard platinum plate exhibiting a 19.9 mm×0.2 mm perimeter. The contact angle exhibited by the ink when deposited drop-wise onto a clean poly(tertafluoroethylene) (PTFE) surface was also measured five times using a Drop Shape Analysis System (DSA10, Krüss USA). The measured data along with the mean average for both the surface tension of the ink and contact angle established against PTFE is provided in Table 8.

TABLE 8

| Measurement # | Surface Tension (mN/m) | Contact Angle on PTFE (degrees) |
|---|---|---|
| i | 31.31 | 65.0 |
| ii | 31.38 | 65.5 |
| iii | 31.37 | 65.5 |
| iv | 31.35 | 65.4 |
| v | 31.34 | 65.6 |
| Average | 31.35 | 65.4 |
| Std. Dev. | 0.03 | 0.2 |

| Calculated from Equation 2 | |
|---|---|
| Polar Component | 3.97 mN/m |
| Dispersive Component | 27.38 mN/m |
| Surface Polarity | 12.66% |

The reason for measuring both the surface tension and the contact angle against PTFE is to separate the surface tension into polar and dispersive components as described by Equation 2 (Fowkes energy theory). The ratio of the polar component to the overall surface tension provides a measurement of the (%) polarity of the surface as shown in Table 8.

Similarly, the surface energy exhibited by the silicone membrane and a polycarbonate substrate was determined using Equation 3 (Fowkes energy theory). Diiodomethane was used as the first standard fluid ($\sigma_L^P$ equal to 0.0 mN/m) exhibiting a measured surface tension ($\sigma_L$ & $\sigma_L^D$) of 50.8 mN/m. The second standard fluid utilized was water exhibiting a measured surface tension (CYL) of 72.8 mN/m, a dispersive component ($\sigma_L^D$) equivalent to 26.4 mN/m and a polar component ($\sigma_L^P$) of 46.4 mN/m. Utilizing the known surface tension values for this standard fluid along with the value for the dispersive component for the substrate's surface energy and the measured contact angle for water against the substrate, the value of the polar component and the overall surface energy for the two silicone membranes (different hardness values) and polycarbonate substrate were determined as shown in Table 9.

TABLE 9

| | Water Droplets Contact Angle (degrees) | | Diiodomethane Droplets Contact Angle (degrees) | |
|---|---|---|---|---|
| Drop # | Soft Membrane (60 durometer, Shore A) | Hard Membrane (75 durometer, Shore A) | Soft Membrane (60 durameter, Shore A) | Hard Membrane (75 durometer, Shore A) |
| 1 | 106.1 | 104.2 | 72.8 | 70.2 |
| 2 | 107.1 | 104.1 | 72.1 | 71.7 |
| 3 | 106.4 | 104.2 | 72.8 | 70.9 |
| 4 | 107.3 | 104.2 | 73.2 | 70.8 |
| 5 | 108.1 | 102.5 | 73.6 | 70.3 |
| 6 | 107.7 | 103.4 | 72.3 | 71 |
| 7 | 107.6 | 103 | 74.1 | 71.3 |
| 8 | 106.2 | 102.7 | 72.9 | 71.9 |
| 9 | 107.9 | 103.8 | 74 | 72.3 |
| 10 | 107.7 | 103.9 | 74.3 | 71.7 |
| Average | 107.2 | 103.6 | 73.2 | 71.2 |
| Std. Dev. | 0.7 | 0.7 | 0.8 | 0.7 |

| Calculated using Equation 3 | Soft Membrane | Hard Membrane |
|---|---|---|
| Overall Surface Energy | 21.19 $mJ/m^2$ | 22.49 $mJ/m^2$ |
| Polar Component | 0.09 $mJ/m^2$ | 0.28 $mJ/m^2$ |
| Dispersive Component | 21.1 $mJ/m^2$ | 22.21 $mJ/m^2$ |
| Surface Polarity | 0.42% | 1.26% |

This example demonstrates that the surface energy exhibited by the extruded silicone membranes of the present invention is less than or equal to 25 mJ/m2. This value of surface energy correlates with a critical wetting tension of about the same number, 25 dynes/cm. In comparison, the surface tension of the ink was found to be greater than 25 dynes/cm. The silicone membranes exhibit a surface polarity which is significantly mismatched to that of the ink (12.66%). Thus this example further demonstrates that the surface polarity of ink is greater than about 10%, while the surface polarity of the membrane is less than about 2%. The surface polarity of the substrate (18.62%) is closer to the surface polarity of the ink, than is the membrane surface polarity. This similarity in surface polarity will promote adhesion between the ink and the surface of the substrate. In order to obtain the best transfer in the MIT process, it is desirable to minimize the adhesion between the membrane and the ink (maximize the mismatch in surface polarity), while maximizing the adhesion energy between the ink and the substrate (minimize surface polarity difference). Thus the surface polarity of the membrane should be less than about 2%, while the surface polarities of the ink and substrate should be greater than about 10% and less than about 20%, respectively, in order to promote acceptable ink transfer in the MIT process.

EXAMPLE 9

Effect of Ramping Squeegee Transverse Speed

Experimental runs were made in which the squeegee transverse speed was the only variable being altered. In this respect, an ink as described in US Patent Application Publication No. U.S. 2003/0116047A1, filed Dec. 19, 2002, was screen printed onto a silicone membrane (60 durometer, Shore A) distributed by Kuriyama of America. The squeegee pressure or force was maintained at the established midpoint, the flood time ranged between 8–30 seconds, and the squeegee angle was 0°, while the squeegee transverse speed was varied from less than 0.22 meters per second to greater than 0.65 meters per second. This upper and lower limit on squeegee transverse speed correlates with dial settings of 1 and 4 on the Saturn screen printer (M&R), respectively.

The laboratory scale MIT apparatus constructed in Example 2 was utilized to transfer the print applied in each experimental run from the silicone membrane to a polycarbonate plaque. All MIT process variables were held constant throughout each experimental run. In this respect, the peel angle of the form fixture was held at 10°, the hardness of the form fixture at 35 durometer, Shore A, the contact time between the printed membrane and the polycarbonate substrate at 2 seconds, and the overall compression force applied between the membrane (form fixture) and substrate (part fixture) at 91 kilograms (200 pounds). In addition, the time between screen printing onto the membrane and the transfer of the print from the membrane to polycarbonate was also held constant at 30 seconds.

Figure 16:
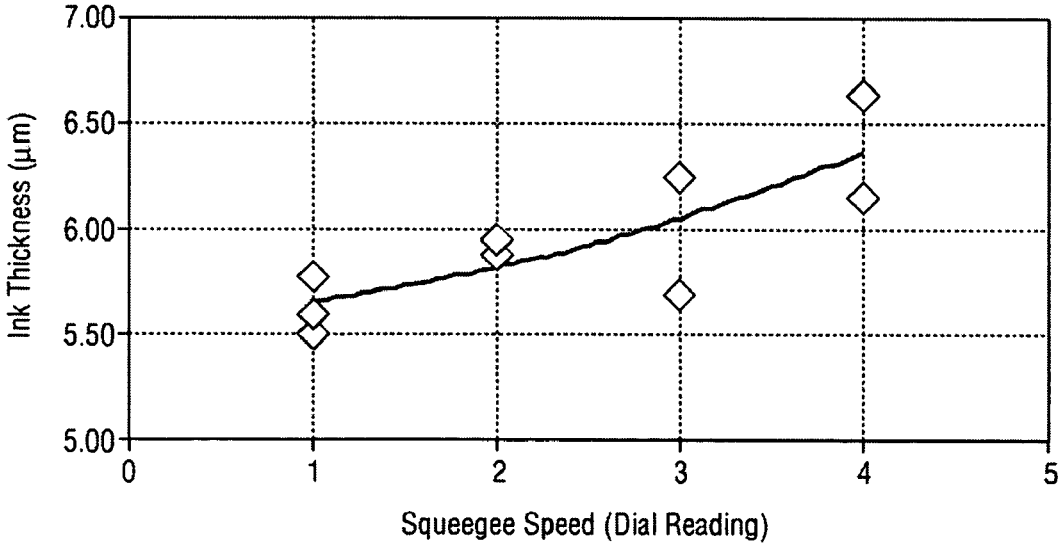
FIG. 16 is a plot of the thickness of a final print as a function of the transverse speed of the squeegee used to deposit the print on to the "soft" membrane.

The inventors found the ink thickness of the transferred print increased as the squeegee transverse speed was elevated as shown in FIG. 16. Increasing the squeegee speed inherently increases the shear environment seen by the ink. Since the inks are shear thinning fluids, their viscosity decreases as a power function of shear rate. The lower viscosity exhibited by the fluid at the onset of printing allows the fluid to more easily flow onto the soft, low surface energy membrane, thereby, increasing film thickness. As shown in Example 6, ink thickness is observed to correlate with an increase in opacity. Thus this example demonstrates that optimum ink thickness can be achieved by operating the squeegee at a transverse speed in excess of the industry standard of 0.22 meters per second or a dial setting of 1 on a Saturn screen printer. The upper limit for a desirable ink thickness of 10 micrometers will not be reached until the speed of the squeegee is greater than about 2.0 meters per second (Dial setting of 11 on a Saturn screen printer).

EXAMPLE 10

Ball Nose Squeegee

A Box Behnken response surface experimental design for three factors was run in order to determine the contour surfaces related to squeegee hardness, membrane hardness, and elapsed time between printing on a "soft" membrane and transferring the print to a "hard" substrate. This experimental design was performed using a ball nose squeegee as the squeegee of choice in the screen printing portion of the MIT process. All other screen printing and transfer printing variables were held constant through out the experimental runs in this example. In the screen printing portion of the MIT process the squeegee pressure or force was maintained at the established midpoint, the flood time held at 30 seconds and the squeegee transverse speed at a dial setting of 2 (0.34 m/s) on the Saturn screen printer (M&R). Likewise in the transfer portion of the MIT process (see Lab scale equipment, Example 2) the peel angle of the form fixture was held at 100, the hardness of the form fixture at 35 durometer, Shore A, the contact time between the printed membrane and the polycarbonate substrate at 2 seconds, and the overall compression force applied between the membrane (form fixture) and substrate (part fixture) at 91 kilograms.

All three variables, namely, squeegee hardness, elapsed time, and membrane hardness, in this example were varied between three different levels. The hardness of the ball nose squeegee was varied between 57, 71, and 85 durometer, Shore A. The hardness of the membrane was varied between about 60 (Kuriyama of America), 80 (Ja-Bar Silicones Corp.), and 95 (Reiss Manufacturing Inc., Blackstone, Va.) durometer, Shore A. Finally, the elapsed time between printing on the membrane and transferring the print to a substrate was varied between 15, 30, and 45 seconds. The standard ink formulation utilized in this Example is adequately described by U.S. Patent Application Publication No. US2003/0116047A1, filed Dec. 19, 2002.

The ink thickness values measured via profilometery (Dektak 8000, Sloan, a subsidiary of Vicker Industries) for the transferred print in each experimental run of this DOE was analyzed using full ANOVA protocol available with most statistical software packages (e.g., Design-Expert®, StatEase Inc., Minneapolis, Minn.). The resulting contour surface for the thickness of the print obtained as an interaction between two hardness variables (e.g., squeegee and membrane) is provided in FIG. 17. The inventors unexpectedly found that a ball nose squeegee behaves differently than known for squeegees with 0° or 45° angles (see Example #'s 3 & 6). In this respect, a ball nose squeegee with a high hardness value is used to maintain the thickness of the applied print with in the desirable range of 4–10 micrometers. The hardness of the ball nose squeegee preferably is equal to or greater than about 75 durometer, Shore A in order to insure the print thickness is within the preferred range.

Figure 17:
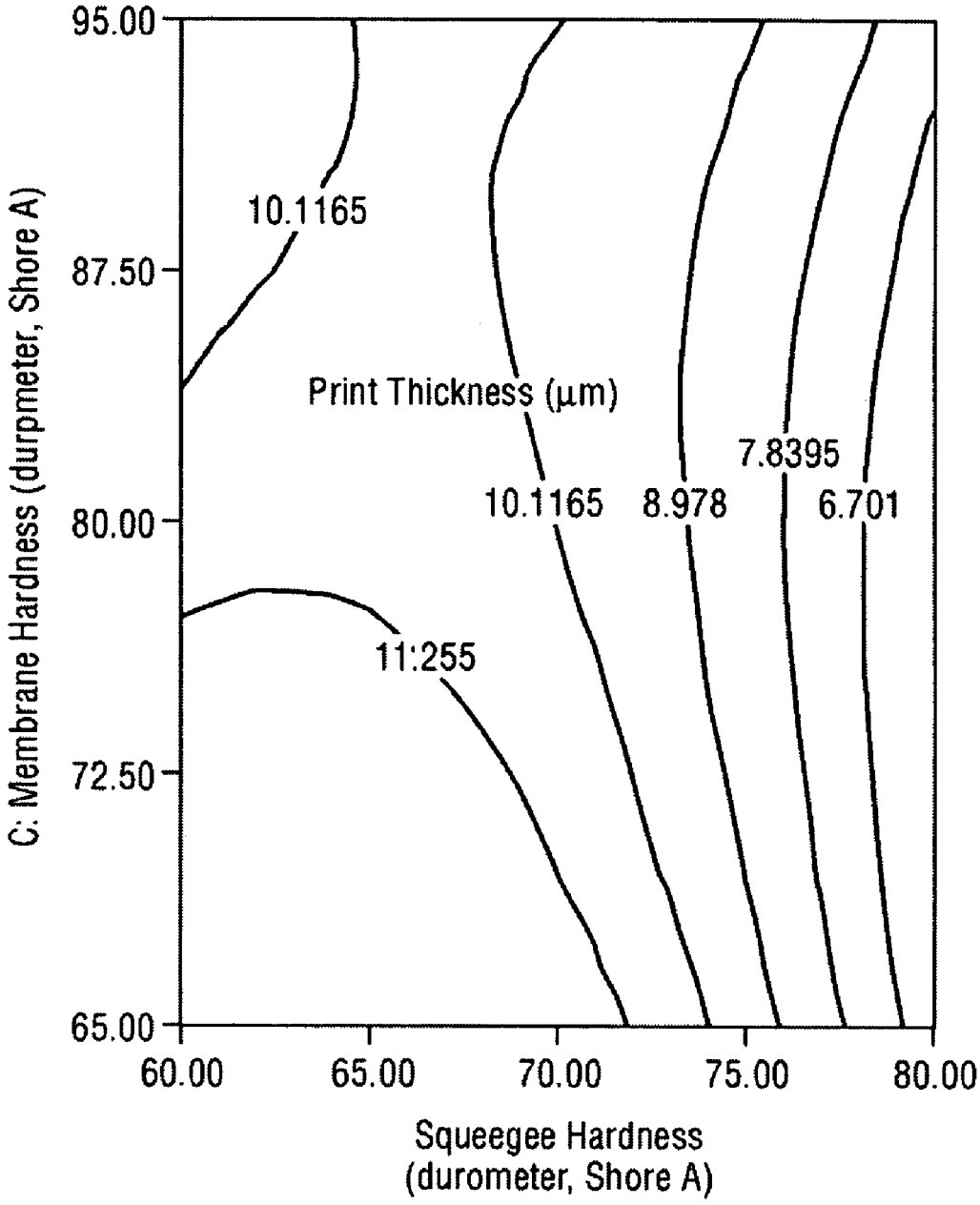
FIG. 17 is a plot of the hardness of the membrane and the hardness of the squeegee.

The contour surface in FIG. 17 further demonstrates that the membrane hardness can be greater than or equal to 60 durometer, Shore A in order to achieve the preferred print thickness when using a ball nose squeegee with an appropriate hardness. However, the larger latitude allowed for squeegee hardness that is provided at greater membrane hardness (e., g., greater than about 75 durometer, Shore A) is preferred.

EXAMPLE 11

Minimizing the Degree of Membrane Swelling

In this example, a silicone membrane of known hardness (67 durometer, Shore A) was subjected to multiple prints in an MIT process. All process parameters were maintained at a constant value through out this example. In the screen printing portion of the MIT process the squeegee pressure or force was maintained at the established midpoint, the flood time held at 30 seconds and the squeegee transverse speed at a dial setting of 2 (0.34 m/s) on the Saturn screen printer (M&R). Likewise in the transfer portion of the MIT process (see Lab scale equipment, Example 2) the peel angle of the form fixture was held at 100, the hardness of the form fixture at 35 durometer, Shore A, the contact time between the printed membrane and the polycarbonate substrate at 2 seconds, and the overall compression force applied between the membrane (form fixture) and substrate (part fixture) at 91 kilograms. Finally, the elapsed time between printing on the membrane and transferring the print to a substrate was maintained at 30 seconds. The ink formulation utilized in this Example is adequately described as being preferred in U.S. Patent Application Publication No. US2003/0116047A1, filed Dec. 19, 2002.

After every five prints, the membrane was exposed to one of several different cleaning procedures. These cleaning procedures were attempting to minimize the swelling of the membrane via the absorption of solvents from the ink. The degree of swelling was monitored as a function of membrane hardness. As the membrane begins to swell the hardness of the membrane begins to decrease. Thus membrane hardness was measured immediately prior to each cleaning attempt. The measured hardness values of the membrane (0.12 cm thick) as a function of prints is provided in Table 10 for five different experimental trials: (1) without any type of cleaning; (2) cleaning by wiping the membrane with a solvent (e.g., retarder) that is present in the ink; (3) wiping the membrane with isopropyl alcohol; (4) heating the membrane; and (5) blowing forced air across the surface of the membrane.

TABLE 10

| # of Prints | No Cleaning | Wipe with Retarder | Wipe with IPA | Heated* | Blowing with forced air |
|---|---|---|---|---|---|
| 0 | 67.5 | 67.5 | 67.5 | 67.5 | 67.5 |
| 1 | 67.5 | 67.5 | 67.5 | 67.5 | 67.5 |
| 5 | 66.0 | 66.0 | 67.5 | 65.0 | 66.0 |
| 10 | 65.0 | 64.5 | 66.0 | 64.5 | 65.0 |
| 15 | 64.0 | 64.5 | 65.5 | 64.5 | 65.0 |
| 20 | 64.5 | 63.5 | 65.5 | 64.0 | 65.0 |
| 25 | 63.0 | 62.5 | 65.0 | 63.5 | 65.0 |
| 30 | 62.5 | 62.5 | 64.5 | 63.0 | 65.0 |
| 35 | 62.5 | 62.0 | 64.5 | 63.0 | 64.5 |
| 40 | 62.5 | 62 | 64.5 | 62.5 | 64.0 |
| 45 | 61.5 | 61.5 | 64.5 | 62.5 | 64.0 |
| 50 | 61.0 | 61.5 | 64.5 | 62 | 63.5 |
| 55 | 61.0 | 61 | 64.5 | 61.5 | 63.5 |
| 60 | 60.5 | 61 | 64.5 | 61.5 | 63.0 |
| | | | Minimized | | Minimized |

*Exposure Time = 12 seconds; Part Temperature ~ 150 F.

The hardness of the membrane (0.32 cm thick) was observed to decrease from 67 durometer, Shore A to 60.5 durometer, Shore A over the first 60 prints when no cleaning procedure was applied. Wiping the surface of the membrane with retarder (e.g., solvent already present as a minor component in the ink) does not alter the swelling of the membrane. Likewise briefly heating the membrane in an IR convection oven does not affect the swelling of the membrane. The two cleaning procedures that reduce the swelling of the membrane as evidenced by maintaining higher hardness values are blowing forced air across the surface of the membrane and wiping the membrane with an alcohol solvent. Silicone membranes are very compatible with alcohols, such as isopropyl alcohol (IPA).

The above experiments were duplicated for the silicone membrane at different levels of thickness (e.g., 0.16 cm and 0.64 cm). The range in hardness values obtained over all membrane thicknesses for two scenarios, namely, no cleaning and wiping with IPA is shown in FIG. 11. A print defect, indicated at 1012, was encountered after approximately 25 prints when using a membrane of 0.16 cm thickness. This print defect caused by membrane swelling was encountered irregardless of the cleaning operation. This defect was not observed to occur with membranes thicker than 0.16 cm.

This example demonstrates that membrane swelling due to solvent absorption from the ink can be minimized by either wiping the surface of the membrane after every 5–15 prints using a solvent compatible with the membrane, such as an alcohol, or by blowing forced air across the surface of the membrane. This example further substantiates that for the MIT process to function properly with no print defects being formed the thickness of the membrane is preferably greater than 0.16 cm with between 0.32 to 0.64 cm being preferred.

A person skilled in the art will recognize from the previous description, modifications and changes can be made to the preferred embodiment of the invention without departing from the scope of the invention as defined in the following claims.

What is claimed is:

1. A method of transferring a membrane image to an article, the method comprising:

providing a printed decoration to be applied onto a low surface energy membrane, the low surface energy membrane having a hardness level of greater than about 70 durometer Shore A and a surface energy of up to 25 $mJ/m^2$;

applying a predetermined pressure with a pressure device to force the printed decoration through a screen onto the low surface energy membrane, the pressure device having a hardness of up to about 70 durometer Shore A;

forming the low surface energy membrane to the geometry of the surface of the article; and applying pressure between the membrane and the article to transfer the membrane image from the membrane to the article.

2. The method of claim 1 wherein the low surface energy membrane has a surface polarity of up to 2%.

3. The method of claim 1 wherein the low surface energy membrane has a thickness of at least 0.16 centimeter.

4. The method of claim 1 wherein the low surface energy membrane includes a thickness of between about 0.3 centimeter and 0.7 centimeter.

5. The method of claim 1 wherein the predetermined pressure is about +/−0.25 turns relative to a center point.

6. The method of claim 1 further comprising cleaning the low surface energy membrane to lessen the decrease in hardness of the low surface energy membrane.

7. The method of claim 6 wherein the cleaning the low surface energy membrane includes at least one of the following steps: applying forced air over the surface of the low surface energy membrane and applying a solvent over the surface of the low surface energy membrane.

8. The method of claim 6 wherein the solvent includes an alcohol.

9. The method of claim 1 wherein the pressure device is a squeegee device formed with an edge having a predetermined angle relative to the screen.

10. The method of claim 9 wherein the predetermined angle is up to 45° relative to the screen.

11. The method of claim 9 wherein the predetermined angle is substantially normal relative to the screen.

12. The method of claim 1 wherein applying pressure between the membrane and the article includes:

pressing the membrane and the article together in forced contact; and maintaining the pressure between the membrane and the article.

13. The method of claim 1 wherein the screen is positioned substantially parallel to the membrane at an off-contact distance of about 3 millimeters to 12 millimeters.

14. The method of claim 1 further comprising flooding the screen with ink to enhance the thickness of the membrane image.

15. The method of claim 14 wherein the step of flooding includes a flood time of at least about 30 seconds.

16. The method of claim 9 wherein the squeegee device has a speed of greater than 0.3 meters per second.

17. The method of claim 1 wherein the screen includes a mesh count of less than about 230 threads per inch.

18. The method of claim 1 wherein the low surface energy membrane is comprised of a high consistency silicone rubber elastomer.

19. The method of claim 18 wherein the high consistency silicone rubber includes a degree of polymerization in the range of about 5,000 to 10,000 and having a molecular weight ranging from about 350,000 to 750,000 amu.

20. The method of claim 1 wherein the printed decoration comprises an ink having a surface polarity of between 10% and 20%.

21. The method of claim 1 wherein the ink has a surface polarity substantially equal to the surface polarity of the article.

22. A method of transferring a membrane image to an article, the method comprising:

providing a printed decoration to be applied onto a low surface energy membrane, the low surface energy membrane having a hardness level of greater than 70 durometer Shore A and a surface energy of up to 25 $mJ/m^2$;

applying a predetermined pressure with a pressure device to force the printed decoration through a screen onto the low surface energy membrane, the pressure device having a hardness of up to 70 durometer Shore A;

cleaning the low surface energy membrane to lessen the decrease in hardness of the low surface energy membrane;

forming the low surface energy membrane to the geometry of the surface of the article; and applying pressure between the membrane and the article to transfer the membrane image from the membrane to the article.

23. The method of claim 22 wherein the low surface energy membrane has a surface polarity of up to 2%.

24. The method of claim 22 wherein the low surface energy membrane has a thickness of at least 0.16 centimeter.

25. The method of claim 22 wherein the low surface energy membrane includes a thickness of between about 0.3 centimeter and 0.7 centimeter.

26. The method of claim 22 wherein the predetermined pressure is about +/−0.25 turns relative to a center point.

27. The method of claim 22 wherein the cleaning the low surface energy membrane includes at least one of the following steps: applying forced air over the surface of the low surface energy membrane and applying a solvent over the surface of the low surface energy membrane.

28. The method of claim 22 wherein the solvent includes an alcohol.

29. The method of claim 22 wherein the pressure device is a squeegee device formed with an edge having a predetermined angle relative to the screen.

30. The method of claim 29 wherein the predetermined angle is up to 45° relative to the screen.

31. The method of claim 29 wherein the predetermined angle is substantially normal relative to the screen.

32. The method of claim 22 wherein applying pressure between the membrane and the article includes:

pressing the membrane and the article together in forced contact; and maintaining the pressure between the membrane and the article.

33. The method of claim 22 wherein the screen is positioned substantially parallel to the membrane at an off-contact distance of about 3 millimeters to 12 millimeters.

34. The method of claim 22 further comprising flooding the screen with ink to enhance the thickness of the membrane image.

35. The method of claim 34 wherein the step of flooding includes a flood time of at least about 30 seconds.

36. The method of claim 29 wherein the squeegee device has a speed of greater than 0.3 meters per second.

37. The method of claim 22 wherein the screen includes a mesh count of less than about 230 threads per inch.

38. The method of claim 22 wherein the low surface energy membrane is comprised of a high consistency silicone rubber elastomer.

39. The method of claim 38 wherein the high consistency silicone rubber includes a degree of polymerization in the range of about 5,000 to 10,000 and having a molecular weight ranging from about 350,000 to 750,000 amu.

40. The method of claim 22 wherein the printed decoration comprises an ink having a surface polarity between 10% to 20%.

41. The method of claim 22 wherein the ink has a surface polarity substantially equal to the surface polarity of the article.

42. A method of transferring a membrane image to an article, the method comprising:

providing a printed decoration to be applied onto a low surface energy membrane, the low surface energy membrane having a hardness level of greater than 70 durometer Shore A and a surface energy of up to 25 $mJ/m^2$;

flooding the screen with ink to enhance the thickness of the membrane image;

applying a predetermined pressure with a pressure device to force the printed decoration through a screen onto the low surface energy membrane, the pressure device having a hardness of up to 70 durometer Shore A;

forming the low surface energy membrane to the geometry of the surface of the article; and applying pressure between the membrane and the article to transfer the membrane image from the membrane to the article.

* * * * *